US005713060A

United States Patent [19]

Sato et al.

[11] Patent Number: 5,713,060

[45] Date of Patent: Jan. 27, 1998

[54] IMAGE FORMING APPARATUS CAPABLE OF DISCHARGING REMAINING SHEETS

[75] Inventors: Kaoru Sato, Minami-ashigara; Tatsuto Tachibana; Masayoshi Takahashi, both of Numazi, all of Japan

[73] Assignee: Canon Kabushiki Kaisha, Tokyo, Japan

[21] Appl. No.: 671,857

[22] Filed: Jun. 28, 1996

[30] Foreign Application Priority Data

| | | | |
|---|---|---|---|
| Jul. 3, 1995 | [JP] | Japan | 7-189773 |
| Jul. 7, 1995 | [JP] | Japan | 7-172123 |
| Nov. 1, 1995 | [JP] | Japan | 7-285324 |

[51] Int. Cl.[6] ..... G03G 21/00

[52] U.S. Cl. ..... 399/20; 271/266

[58] Field of Search ..... 399/20, 19, 405; 271/258.01, 259–263, 258.04, 265.01–265.04, 266

[56] References Cited

U.S. PATENT DOCUMENTS

| | | | |
|---|---|---|---|
| 4,231,567 | 11/1980 | Ziehm | 399/21 X |
| 4,247,193 | 1/1981 | Kaneko et al. | 399/20 |
| 5,154,411 | 10/1992 | Saito et al. | 271/289 |
| 5,481,336 | 1/1996 | Tachibana et al. | 399/18 |

*Primary Examiner*—Nestor Ramirez

*Attorney, Agent, or Firm*—Fitzpatrick, Cella, Harper & Scinto

[57] ABSTRACT

An image forming apparatus includes an image forming unit for forming an image on a sheet, a first conveying unit for conveying a sheet along a first conveying path toward the image forming unit, a second conveying unit for conveying a sheet along a second conveying path toward the image forming unit, a first detection unit for detecting the sheet remaining in the first conveying path, a second detection unit for detecting the sheet remaining in the second conveying path, and a control unit for discharging the sheets in the first and second conveying paths from the image forming apparatus by simultaneously driving the first and second conveying units whether or not the sheets in the first and second conveying paths are conveyed superposed in the image forming unit, in accordance with the detection of the remaining sheets by the first and second detection units, before the image forming unit starts image formation.

7 Claims, 18 Drawing Sheets

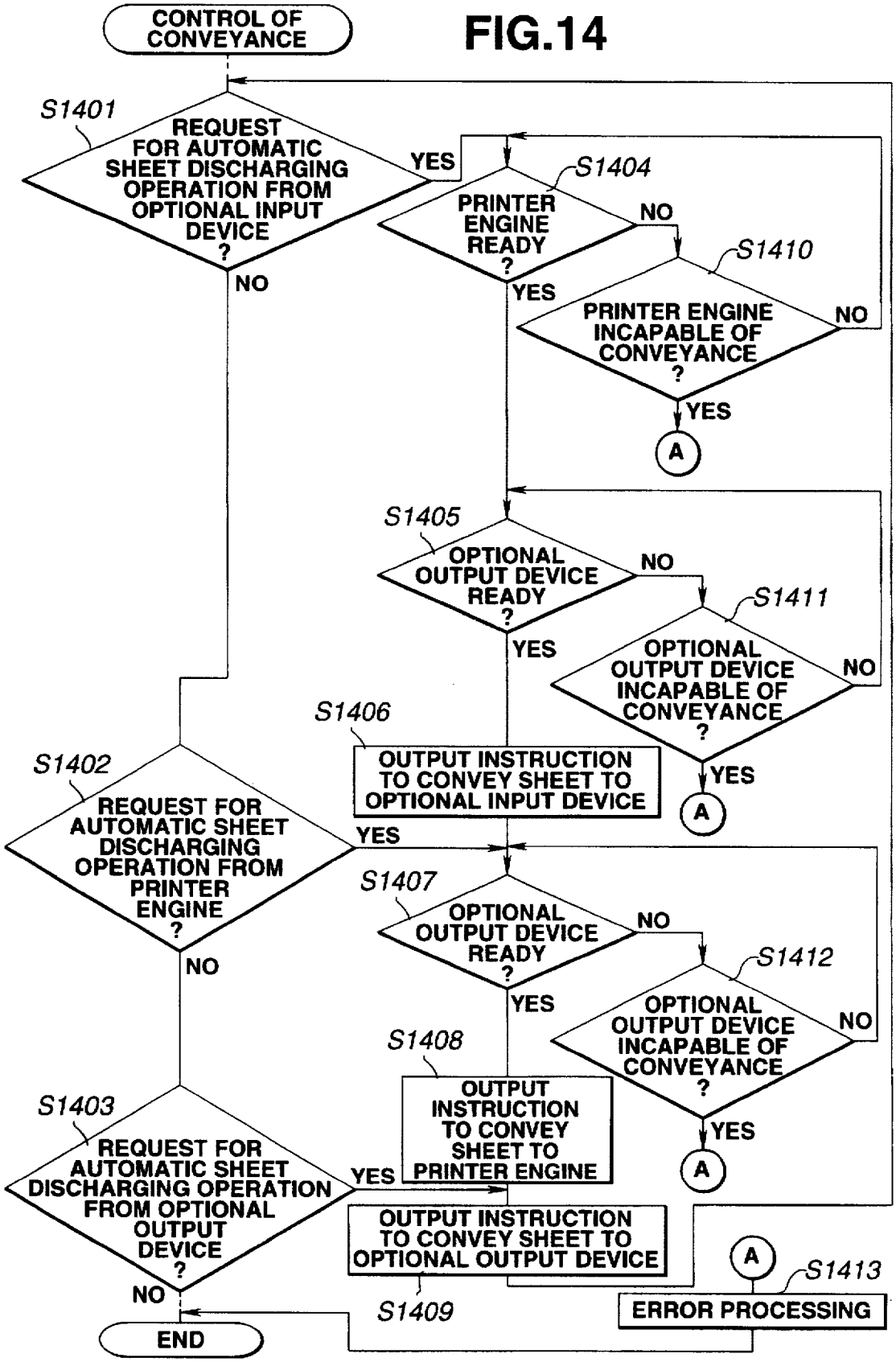
FIG.14
CONTROL OF CONVEYANCE
S1401
REQUEST FOR AUTOMATIC SHEET DISCHARGING OPERATION FROM OPTIONAL INPUT DEVICE ?
YES
NO
S1404
PRINTER ENGINE READY ?
NO
YES
S1410
PRINTER ENGINE INCAPABLE OF CONVEYANCE ?
NO
YES
A
S1405
OPTIONAL OUTPUT DEVICE READY ?
NO
YES
S1411
OPTIONAL OUTPUT DEVICE INCAPABLE OF CONVEYANCE ?
NO
YES
A
S1406
OUTPUT INSTRUCTION TO CONVEY SHEET TO OPTIONAL INPUT DEVICE
S1402
REQUEST FOR AUTOMATIC SHEET DISCHARGING OPERATION FROM PRINTER ENGINE ?
YES
NO
S1407
OPTIONAL OUTPUT DEVICE READY ?
NO
YES
S1412
OPTIONAL OUTPUT DEVICE INCAPABLE OF CONVEYANCE ?
NO
YES
A
S1408
OUTPUT INSTRUCTION TO CONVEY SHEET TO PRINTER ENGINE
S1403
REQUEST FOR AUTOMATIC SHEET DISCHARGING OPERATION FROM OPTIONAL OUTPUT DEVICE ?
YES
NO
OUTPUT INSTRUCTION TO CONVEY SHEET TO OPTIONAL OUTPUT DEVICE
S1409
A
S1413
ERROR PROCESSING
END

IMAGE FORMING APPARATUS CAPABLE OF DISCHARGING REMAINING SHEETS

BACKGROUND OF THE INVENTION

1. Field of the Invention

This invention relates to an image forming apparatus which can discharge sheets remaining within the apparatus before starting an image forming operation.

2. Description of the Related Art

In a conventional printer capable of performing printing on both surfaces of a sheet (duplex printing), when, because of some reason, a sheet whose first surface has been subjected to a printing operation and whose second surface is not yet subjected to a printing operation remains in a refeeding path, and another sheet not yet subjected to a printing operation remains in a state of being fed to a mid-course, one of the two sheets is first discharged, and the other sheet is thereafter discharged.

However, when the sheets are sequentially discharged in the above-described manner, a considerable amount of time is required until the sheets are completely discharged.

SUMMARY OF THE INVENTION

It is an object of the present invention to provide an image forming apparatus which solves the above-described problems.

It is another object of the present invention to provide an image forming apparatus which can discharge a sheet remaining within the apparatus in a short time period before starting an image forming operation.

According to one aspect, the present invention which achieves these objectives relates to an image forming apparatus comprising image forming means for forming an image on a sheet, first conveying means for conveying a sheet along a first conveying path toward the image forming means, a second conveying means for conveying a sheet along a second conveying path toward the image forming means, first detection means for detecting the sheet remaining in the first conveying path, second detection means for detecting the sheet remaining in the second conveying path, and control means for discharging the sheets in the first and second conveying paths from the image forming apparatus by simultaneously driving the first and second conveying means whether or not the sheets in the first and second conveying paths are conveyed superposed in the image forming means, in accordance with the detection of the remaining sheets by the first and second detection means, before the image forming means starts image formation.

According to another aspect, the present invention which achieves these objectives relates to an image forming apparatus comprising image forming means for forming an image on a sheet, first conveying means for conveying a sheet along a first conveying path toward the image forming means, a second conveying means for conveying a sheet along a second conveying path toward the image forming means, and control means for discharging the sheets in the first and second conveying paths from the image forming apparatus by simultaneously driving the first and second conveying means whether or not the sheets in the first and second conveying paths are conveyed superposed in the image forming means, before the image forming means starts image formation.

The foregoing and other objects, advantages and features of the present invention will become more apparent from the following description of the preferred embodiments taken in conjunction with the accompanying drawings.

BRIEF DESCRIPTION OF THE DRAWINGS

FIG. 14 is a flowchart illustrating the control of conveyance of a sheet in a fifth embodiment of the present invention;

DESCRIPTION OF THE PREFERRED EMBODIMENTS

First Embodiment

FIGS. 1 through 4 are diagrams illustrating a first embodiment of the present invention.

First, the configuration of a recording apparatus 301 according to the first embodiment will be described with reference to FIG. 3.

Figure 3:
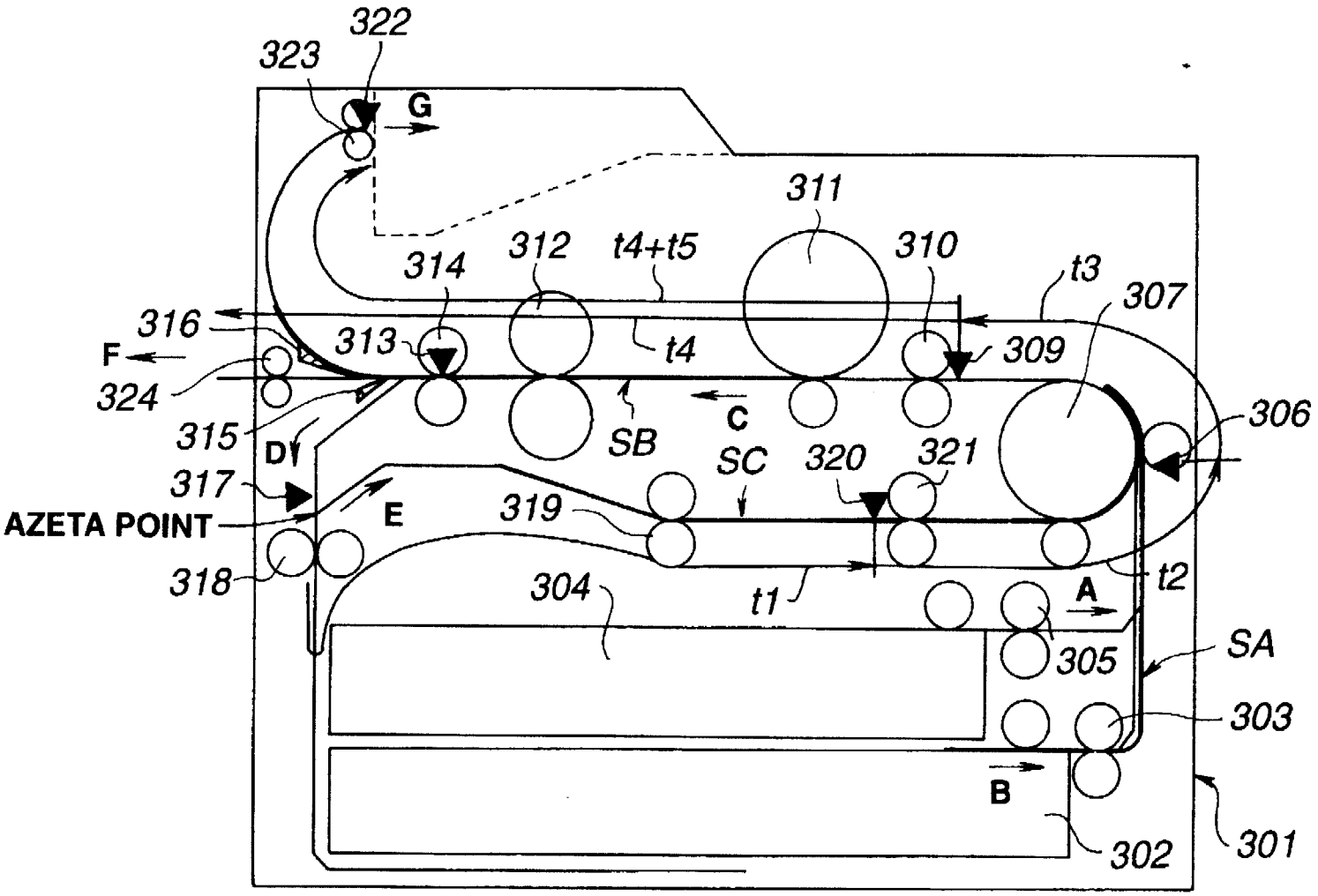
FIG. 3 is a schematic block diagram illustrating the configuration of the entirety of a recording apparatus according to the first embodiment.

In FIG. 3, there are shown an upper deck 304 and a lower deck 302. A duplex conveying mechanism is configured by switchback rollers 318 and duplex conveying rollers 321. A sheet fed from the upper deck 304 or the lower deck 302 in the direction of an arrow A or B, respectively, first turns on a fed-sheet sensor 306, is then conveyed by a fed-sheet conveying roller 307 and turns on a preregistration sensor 309, and waits while forming a predetermined loop at the position of registration rollers 310. Then, the sheet is conveyed in the direction of an arrow C in response to a synchronizing signal from a controller (not shown), passes through a photosensitive drum 311, fixing rollers 312 and fixed-sheet discharging rollers 314, and turns on a fixed/discharged-sheet sensor 313.

When a duplex printing operation is designated by the controller, a duplex flapper 315 operates to guide the sheet in the direction of an arrow D. The sheet then passes through a switchback sensor 317, and is subjected to switchback by the switchback rollers 318. The sheet is then guided in the direction of an arrow E to pass through first duplex conveying rollers 319, a duplex sensor 320, second duplex conveying rollers 321, and is refed in the direction of the arrow C by the fed-sheet conveying roller 307.

When a face-up (hereinafter termed "FU") sheet discharging operation is designated by the controller, a flapper 316 is set upward, and the sheet is discharged onto an FU tray present in the direction of an arrow F by FU rollers 324.

When a face-down (hereinafter termed "FD") sheet discharging operation is designated, the flapper 316 is set downward, and the sheet is discharged onto an FD tray present in the direction of an arrow G after passing through a discharged-FD-sheet sensor 322 and FD-sheet discharging rollers 323.

Figure 4:
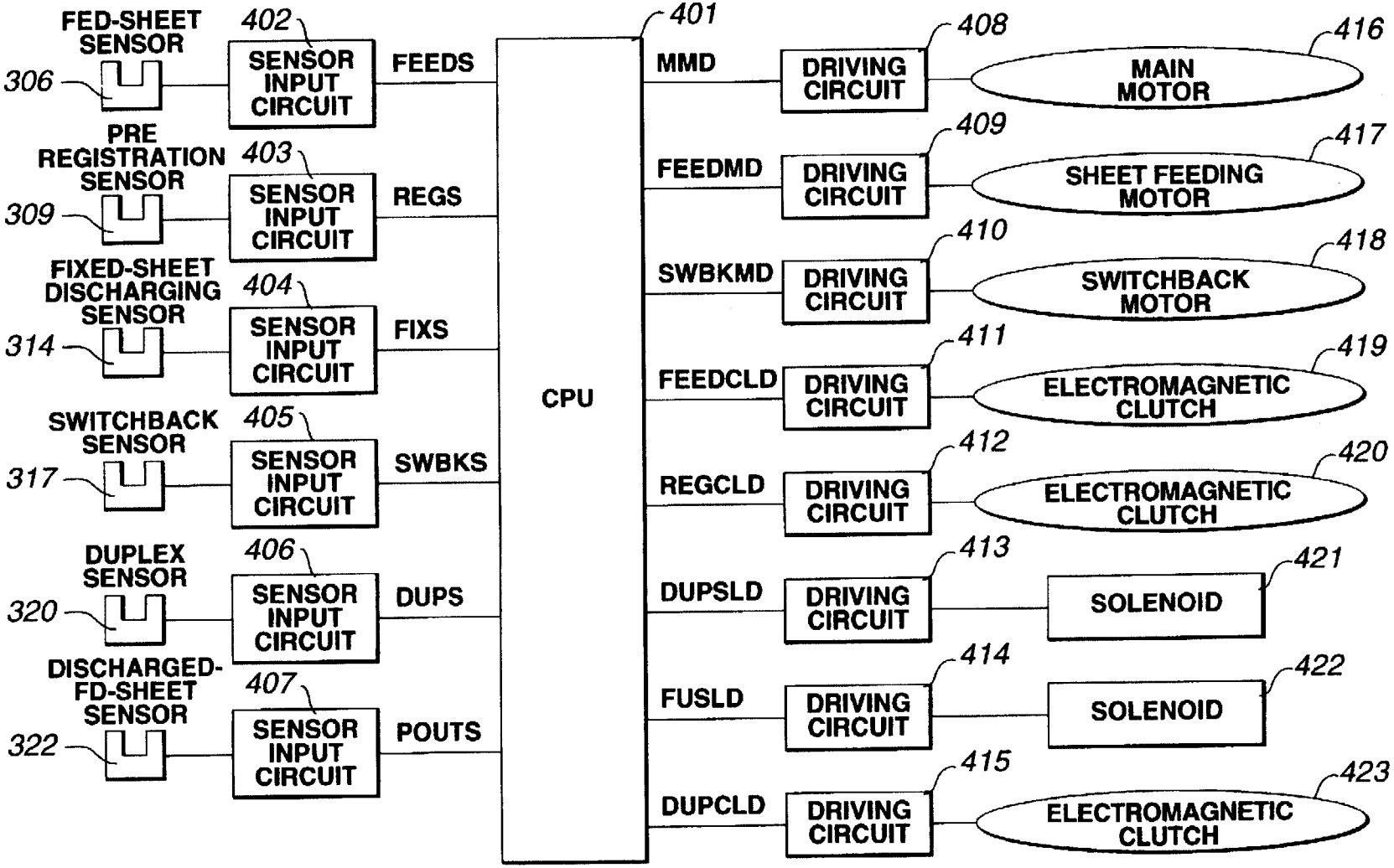
FIG. 4 is a block diagram illustrating the configuration of a control system in the recording apparatus shown in FIG. 3.

FIG. 4 is a block diagram illustrating driving circuits for respective driving units, and sensor input circuits of the sheet feeding mechanism shown in FIG. 3. In FIG. 4, a single-chip microprocessor (hereinafter termed a "CPU") 401 incorporates a ROM (read-only memory) and a RAM (random access memory). Sensor input circuits 402, 403, 404, 405, 406 and 407 input a fed-sheet sensor signal (hereinafter termed a "FEEDS"), a preregistration sensor signal (hereinafter termed a "REGS"), a fixed/discharged-sheet sensor signal (hereinafter termed a "FIXS"), a switchback sensor signal (hereinafter termed a "SWBKS"), a duplex sensor signal (hereinafter termed a "DUPS"), and a discharged-FD-sheet sensor signal (hereinafter termed a "POUTS"), respectively, to the CPU 401.

A driving circuit 408 rotates a main motor 418, and inputs a driving signal (hereinafter termed an "MMD") from the CPU 401. The main motor 418 rotates the fed-sheet conveying roller 307, the registration rollers 310, the photosensitive drum 311, the fixing rollers 312, the fixed-sheet discharging rollers 314 and the FD-sheet discharging rollers 323. Reference numeral 409 represents a driving circuit for a sheet feeding motor 417 for rotating upper sheet feeding rollers 305 and lower sheet feeding rollers 303. The driving circuit 409 receives a driving signal (hereinafter termed a "FEEDMD") from the CPU 401. Reference numeral 410 represents a driving circuit for a switchback motor 418 for rotating the switchback rollers 318 and the second duplex conveying rollers 321. The driving circuit 410 receives a driving signal (hereinafter termed a "SWBKMD") from the CPU 401. Reference numeral 411 represents a driving circuit for an electromagnetic clutch 419 for transmitting the driving force of the main motor 418 to the fed-sheet conveying rollers 307. The driving circuit 411 receives a driving signal (hereinafter termed a "FEEDCLD") from the CPU 401. Reference numeral 412 represents a driving circuit for an electromagnetic clutch 420 for transmitting the driving force of the main motor 416 to the registration rollers 310. The driving circuit 412 receives a driving signal (hereinafter termed a "REGCLD") from the CPU 401. Reference numeral 413 represents a driving circuit for a solenoid 421 for operating the duplex flapper 315. The driving circuit 413 receives a driving signal (hereinafter termed a "DUPSLD") from the CPU 401. Reference numeral 414 represents a driving circuit for a solenoid 422 for operating the flapper 316. The driving circuit 414 receives a driving signal (hereinafter termed a "FUSLD") from the CPU 401. Reference numeral 415 represents a driving circuit for an electromagnetic clutch 423 for transmitting the driving force of the switchback motor 418 to the duplex conveying rollers 319 and 321. The driving circuit 415 receives a driving signal (hereinafter termed a "DUPCLD") from the CPU 401.

Figure 1:
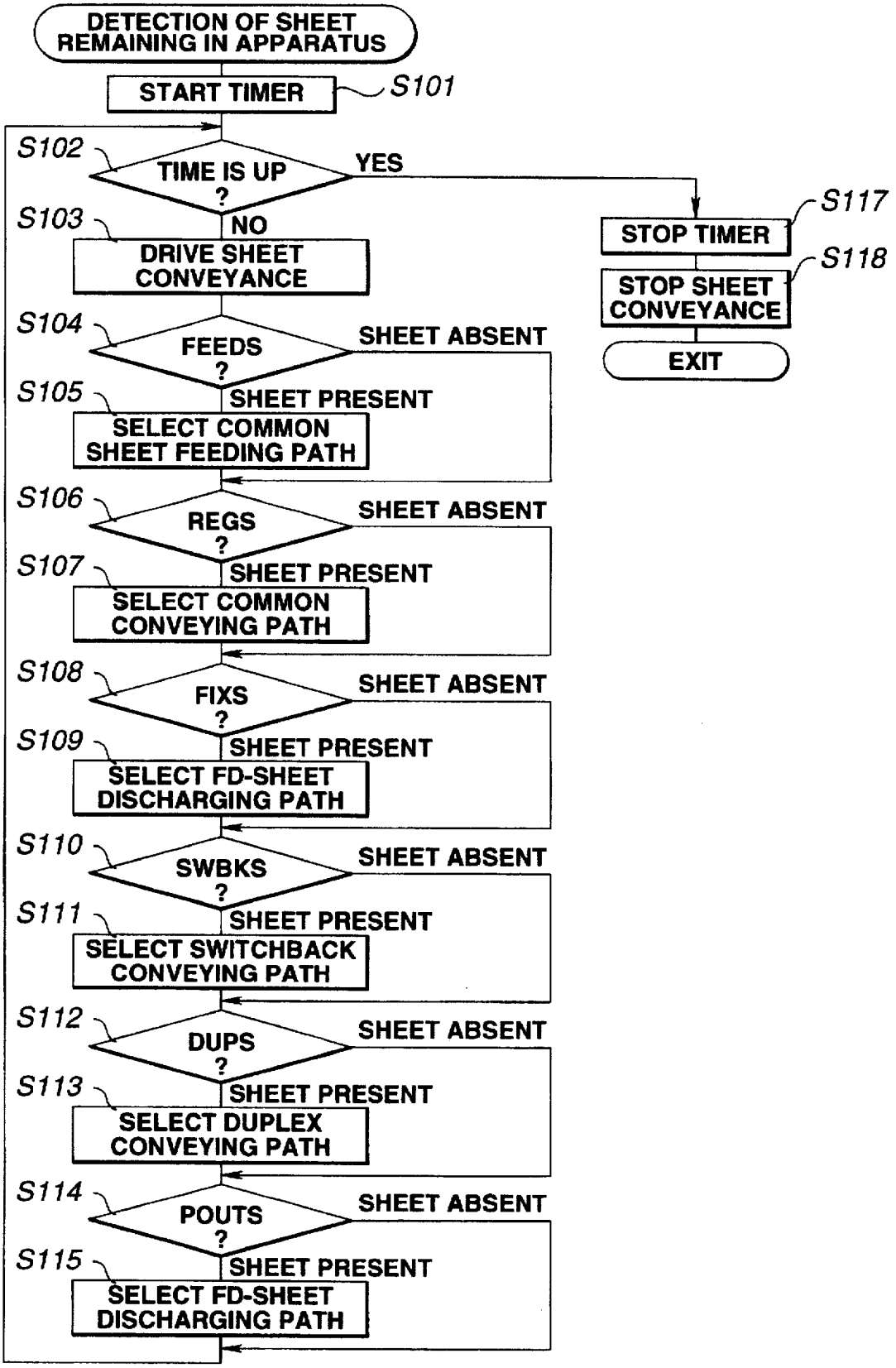
FIG. 1 is a flowchart illustrating procedures of detection of a sheet remaining within an apparatus in a first embodiment of the present invention.
Figure 2:
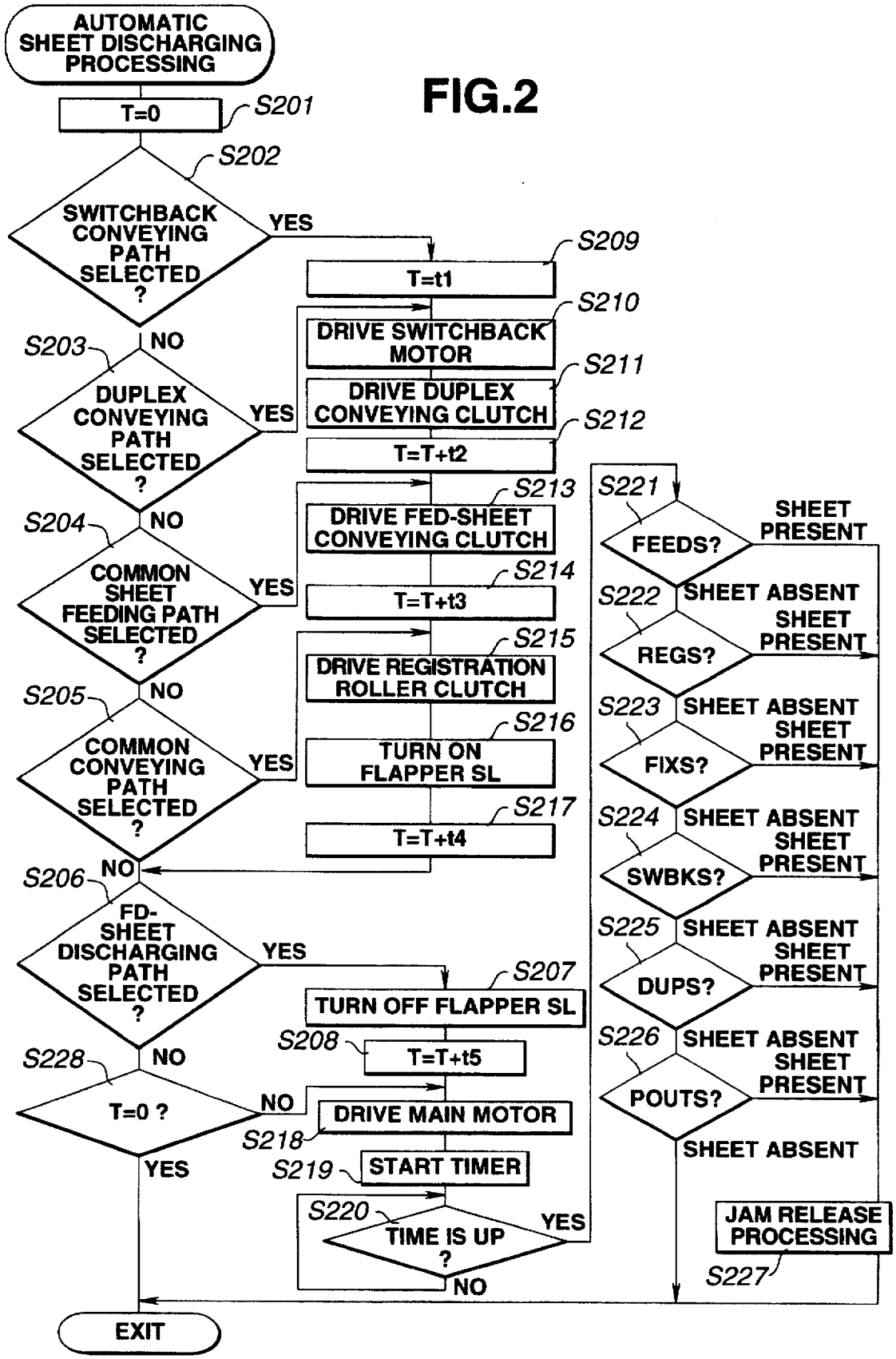
FIG. 2 is a flowchart illustrating procedures of automatic sheet discharging processing in the first embodiment.

FIGS. 1 and 2 are flowcharts illustrating controls according to programs stored in the ROM of the CPU 401. FIG. 1 illustrates processing of detection of a sheet remaining in the apparatus performed at an initial state of the recording apparatus 301, for example, when electric power is supplied to the recording apparatus 301, or when the front door is closed after jam release processing by the operator. The presence of sheets in the apparatus is detected by the respective sensors in the following manner by operating all the driving units shown in FIG. 4 for a certain time period. In the following flowcharts, each step is indicated by being preceded by S, as step S101.

First, in step S101 in FIG. 1, a timer for regulating the operating time period for all of the respective driving units is started. In step S102, it is determined if the predetermined operating time period has elapsed in the timer. If the result of the determination in step S102 is affirmative, the process proceeds to step S117, where the timer is stopped. In step S118, the respective driving units are stopped. If the result of the determination in step S102 is negative, in step S103, the operations of the respective driving circuits 408–415 are kept to continue. A sheet remaining in the apparatus is detected during the operations of the respective driving units.

For detecting a sheet remaining in the apparatus, first, in step S104, the detection of a signal FEEDS from the fed-sheet sensor 308, i.e., the detection of a sheet by the fed-sheet sensor 308, is determined. When the presence of a sheet has been detected in step S104, then, in step S105, a common sheet feeding path to the registration rollers 310 is selected as an automatic sheet discharging path. An example of the position of the remaining sheet at that time is indicated by SA in FIG. 3. In the next step S106, the presence of a signal REGS from the preregistration sensor 309 is detected. When the presence of a sheet has been detected in step S106, then, in step S107, a common conveying path from the registration rollers 310 to the fixed-sheet discharging rollers 314 is selected as an automatic sheet discharging path. In the next step S108, the presence of a signal FIXS from the fixed/discharged-sheet sensor 313 is detected. When the presence of a sheet has been detected in step S108, there is the possibility that, as indicated by SB in FIG. 3, the leading edge of the sheet has already started to move toward an FD-sheet discharging portion in the direction of the arrow G. Hence, in step S109, an FD-sheet discharging path to the FD-sheet discharging rollers 323 is selected. In the next step S110, the presence of a signal SWBKS from the switchback sensor 317 is detected. When the presence of a sheet has been detected in step S110, then, in step S111, a switchback conveying path is selected in order to perform switchback of the sheet at a switchback branching point (hereinafter termed an "AZETA point"). In the next step S112, the presence of a signal DUPS from the duplex sensor 320 is detected. When the presence of a sheet has been detected in step S320, then, in step S113, a duplex conveying path to the fed-sheet conveying roller 307 is selected as an automatic sheet discharging/conveying path. An example of the position of the remaining sheet at that time is indicated by SC in FIG. 3. In the next step S114, the presence of a signal POUTS from the discharged-FD-sheet sensor 322 is detected. If the presence of a sheet has been detected in step S114, then, in step S115, an FD-sheet discharging path is selected as an automatic sheet discharging/conveying path.

FIG. 2 is a flowchart illustrating automatic sheet discharging processing to be executed after the processing of the detection of a sheet remaining in the apparatus shown in FIG. 1.

First, in step S201, an initial value 0 for the automatic sheet discharging time period T is set in the timer. Unless a sheet remaining in the apparatus has been detected in the processing of the detection of a sheet remaining in the apparatus shown in FIG. 1, a value other than 0 is not set for T in the following processing.

In step S202, it is determined if a switchback conveying path has been selected in the processing of the detection of a sheet remaining in the apparatus shown in FIG. 1. If the result of the determination in step S202 is affirmative, a switchback conveying time period t1, i.e., a time period required until the sheet is conveyed to the position of the duplex sensor 320 after being subjected to switchback at the AZETA point, is set for T (step S209). The time period t1 is a time period required for performing switchback and conveying a sheet having the maximum size. Thereafter, the processes from step S210 to step S219 are performed in accordance with the contents of selection of an automatic sheet discharging/conveying path, and as will be described later, a driving time period required for discharging the sheet is set.

If the result of the determination in step S202 is negative, the process proceeds to step S203, where it is determined if a duplex conveying path has been selected. If the result of the determination in step S203 is affirmative, driving signals SWBKMD and DUPCLD are turned on in steps S210 and 211 to drive the switchback motor 418 and the electromagnetic clutch 423 for duplex conveyance, respectively. In step S212, a time period t2 required for conveying the sheet from the duplex sensor 320 to the fed-sheet sensor 308 is added to T. If the result of the determination in step S203 is negative, the process proceeds to step S204, where it is determined if a common sheet feeding path has been selected. If the result of the determination in step S204 is affirmative, the process proceeds to step S213, where a driving signal FEEDCLD is output in order to rotate the fed-sheet conveying roller 307. In step S214, a time period t3 required for conveying the sheet from the fed-sheet sensor 308 to the preregistration sensor 309 is added to T. If the result of the determination in step S204 is negative, the process proceeds to step S205, where it is determined if a common conveying path has been selected. If the result of the determination in step S205 is affirmative, then, in step S215, a driving signal REGCLD is output in order to rotate the registration rollers 310. Then, in step S216, a driving signal FUSLD for operating the flapper 316 is turned on in order to discharge the sheet onto the FU tray present in the direction of the arrow F along the shortest sheet discharging path. In step S217, a time period t4 is added to T. The time period t4 is a time period obtained by adding a time period required for the portion from the leading edge to the trailing edge of a sheet having the largest size to pass through the position of the fixed/discharged-sheet sensor 313 to the conveying time until the leading edge of the sheet reaches the fixed/discharged-sheet sensor 313 from the preregistration sensor 309.

If the result of the determination in step S205 is negative, the process proceeds to step S206, where it is determined if an FD-sheet discharging path has been selected, i.e., if the sheet can be correctly discharged onto the FU tray. If the result of the determination in step S206 is affirmative, the process proceeds to step S207, where the driving signal FUSLD output in step S216 is turned off. In step S208, a period time t5 is added to T. This time period t5 corresponds to the difference between the length of the FD-sheet discharging path and the length of the FU-sheet discharging path. The time period (t4+t5) is obtained by adding the time period required for the portion between the leading edge and the trailing edge of a sheet having the maximum size to pass through the position of the discharged-FD-sheet sensor 322 to the conveying time period until the leading edge of the sheet reaches the discharged-FD-sheet sensor 322 from the preregistration sensor 309.

If the result of the determination in step S206 is negative, the process proceeds to step S228, where it is determined if the automatic sheet discharging time period T equals zero. If the result of the determination in step S228 is negative, the process proceeds to step S218, where a driving signal MMD is output in order to rotate the main motor 416 for automatic sheet discharging processing. Then, in step S219, a timer for measuring the automatic sheet discharging time period is started. In step S220, it is awaited until the predetermined automatic sheet discharging time period T elapses. Accordingly, the automatic sheet discharging processing continues during the automatic sheet discharging time period T. After the lapse of the automatic sheet discharging time period, detection signals from all of the sensors 306–322 along the sheet conveying path are read in steps S221–S226 to confirm the presence/absence of a sheet. When one of the sensors 306–322 has detected the presence of a sheet, it is determined that the automatic sheet discharging processing has failed, and jam release processing is performed in step S227 and the automatic sheet discharging processing is terminated.

The above-described flows of steps S209–S217 and steps S207, 208, 218 and 219 are instantaneously executed. Hence, the operations of driving the respective motors, clutches and solenoids are substantially simultaneously started. Accordingly, if the above-described processing is performed when sheets remain at the positions SA and SC shown in FIG. 3, the two sheets are conveyed while being superposed (this phenomenon is termed "superposed conveyance"). In such a configuration in which a plurality of conveying paths join at a side upstream of the photosensitive drum, sheets are discharged while being superposed by simultaneously driving the respective units. Hence, it is possible to discharge remaining sheets within the shortest time period, and to shift to the next printing operation. When a sheet is present only at one of the positions SA and SC, it is, of course, unnecessary to perform superposed conveyance. Hence, the sheet is discharged in an unsuperposed state. As described above, sheets in a plurality of conveying paths are simultaneously discharged whether or not the sheets in the plurality of conveying paths are subjected to superposed conveyance. The plurality of conveying paths may have various forms, which will now be described as other embodiments.

Second Embodiment

Figure 8:
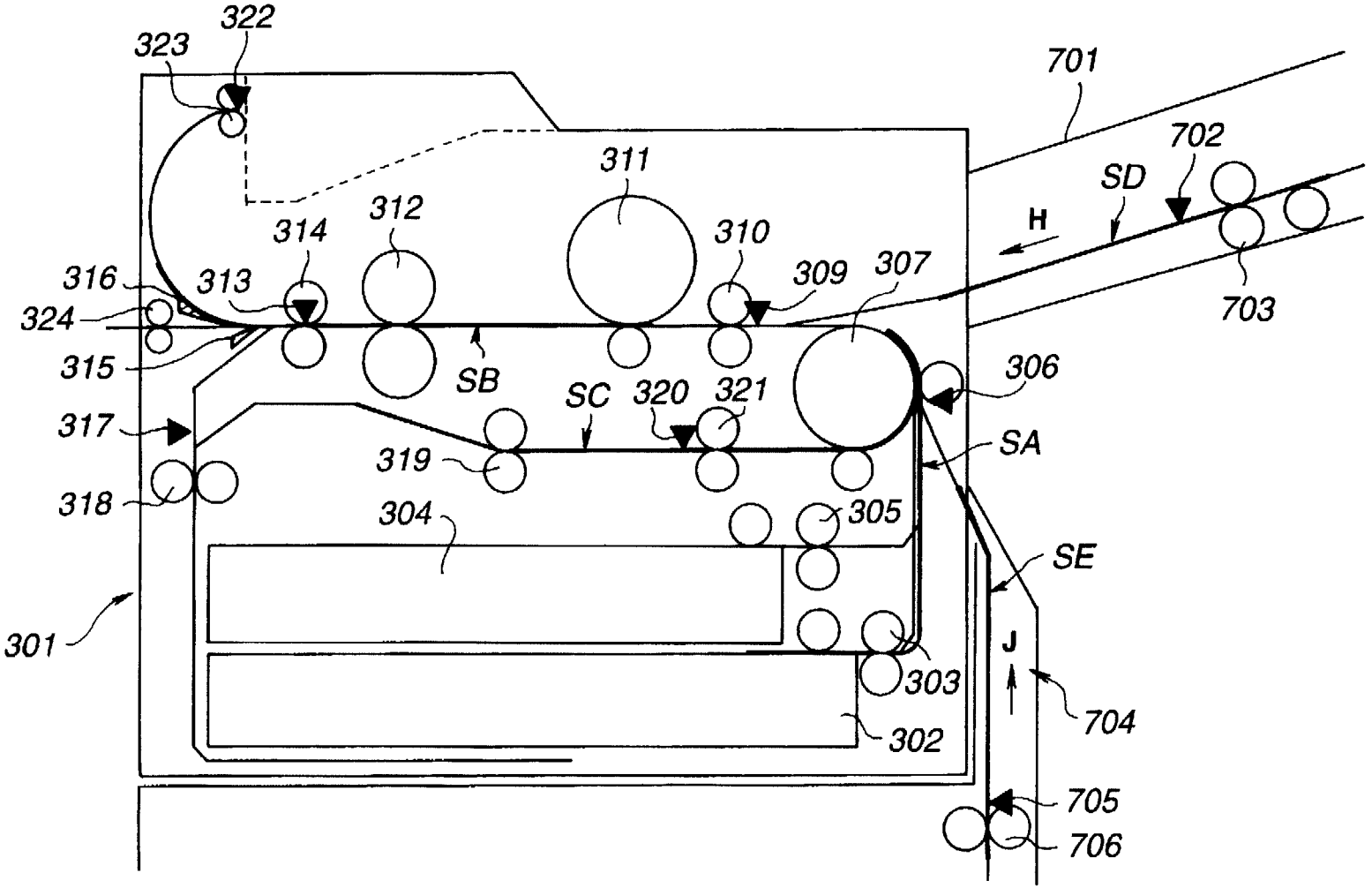
FIG. 8 is a schematic block diagram illustrating the configuration of the entirety of a recording apparatus according to the second embodiment.

First, a description will be provided of the configuration of a recording apparatus 301 according to a second embodiment of the present invention. In the first embodiment, the sheet feeding unit is set in advance in the recording apparatus 301. In the second embodiment, however, the function of a sheet feeding unit is extended to an optional input device. In FIG. 8, a sheet feeding device 701 dedicated for envelopes (hereinafter termed an "envelope feeder") feeds an envelope into the main body of the recording apparatus 301 using envelope feeding rollers 703. A sheet sensor 702 is provided above the sheet feeding path for the envelope. An optional input device (hereinafter termed an "optional deck") 704 can include a large-capacity sheet feeding device or a multideck sheet feeding device. Reference numeral 706 represents conveying rollers at the final stage of the sheet feeding device 704, and reference numeral 705 represents a sheet sensor present along the final conveying path. Each of these optional devices 701 and 704 includes a control unit comprising a microprocessor (not shown) in order to control the device. The CPU 401 (see FIG. 4) of the main body of the recording apparatus 301 exchanges information relating to instructions and states with the above-described control unit using a serial communication function.

Figure 5:
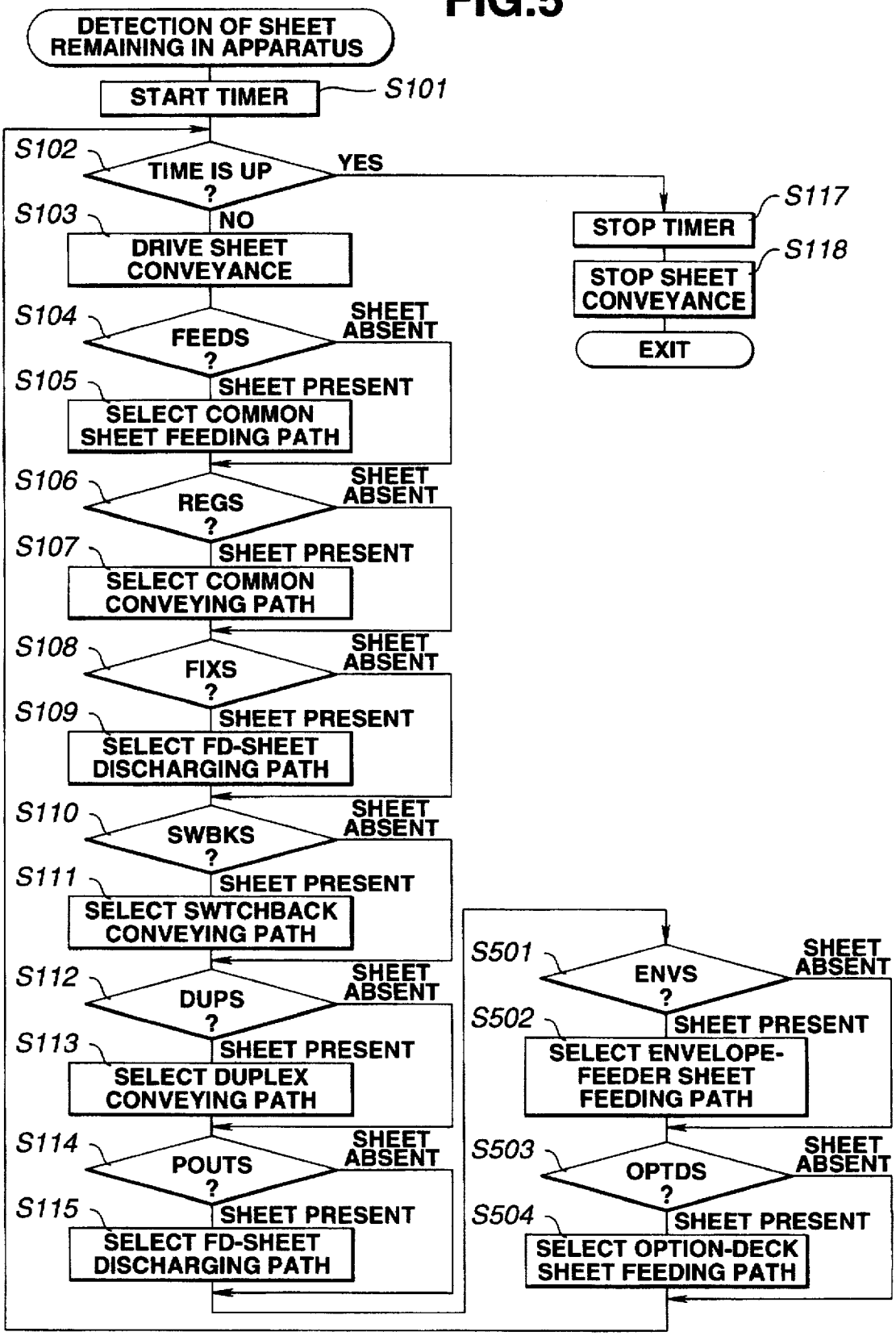
FIG. 5 is a flowchart illustrating procedures of detection of a sheet remaining within an apparatus in a second embodiment of the present invention.

FIG. 5 is a flowchart of processing of detecting a sheet remaining in the apparatus in the second embodiment. Since the outline of the processing is the same as that of the first embodiment, only portions different from the first embodiment will be described. In the second embodiment, the evelope feeder 701 and the optional deck 704 are added to the configuration of the first embodiment. Hence, not only a sheet remaining within the recording apparatus 301, but also sheets remaining within the envelope feeder 701 and the optional deck 704 are detected. First, serial communication is performed between the CPU 401 and the envelope feeder 701. When it has been determined in step S501 that a sheet is present based on a signal ENVS from the fed-envelope sensor 702, then, in step S502, an envelope-feeder sheet feeding path is selected as an automatic sheet discharging/conveying path. An example of the state of the remaining sheet (envelope) at that time is indicated by SD in FIG. 8. Similarly, serial communication is performed between the CPU 401 and the optional deck 704. When it has been determined in step S503 that a sheet is present based on a signal OPTDS from the optional-deck sheet sensor 705, then, in step S504, an optional-deck sheet feeding path is selected as an automatic sheet discharging/conveying path. An example of the state of the remaining sheet at that time is indicated by SE in FIG. 8.

Figure 6:
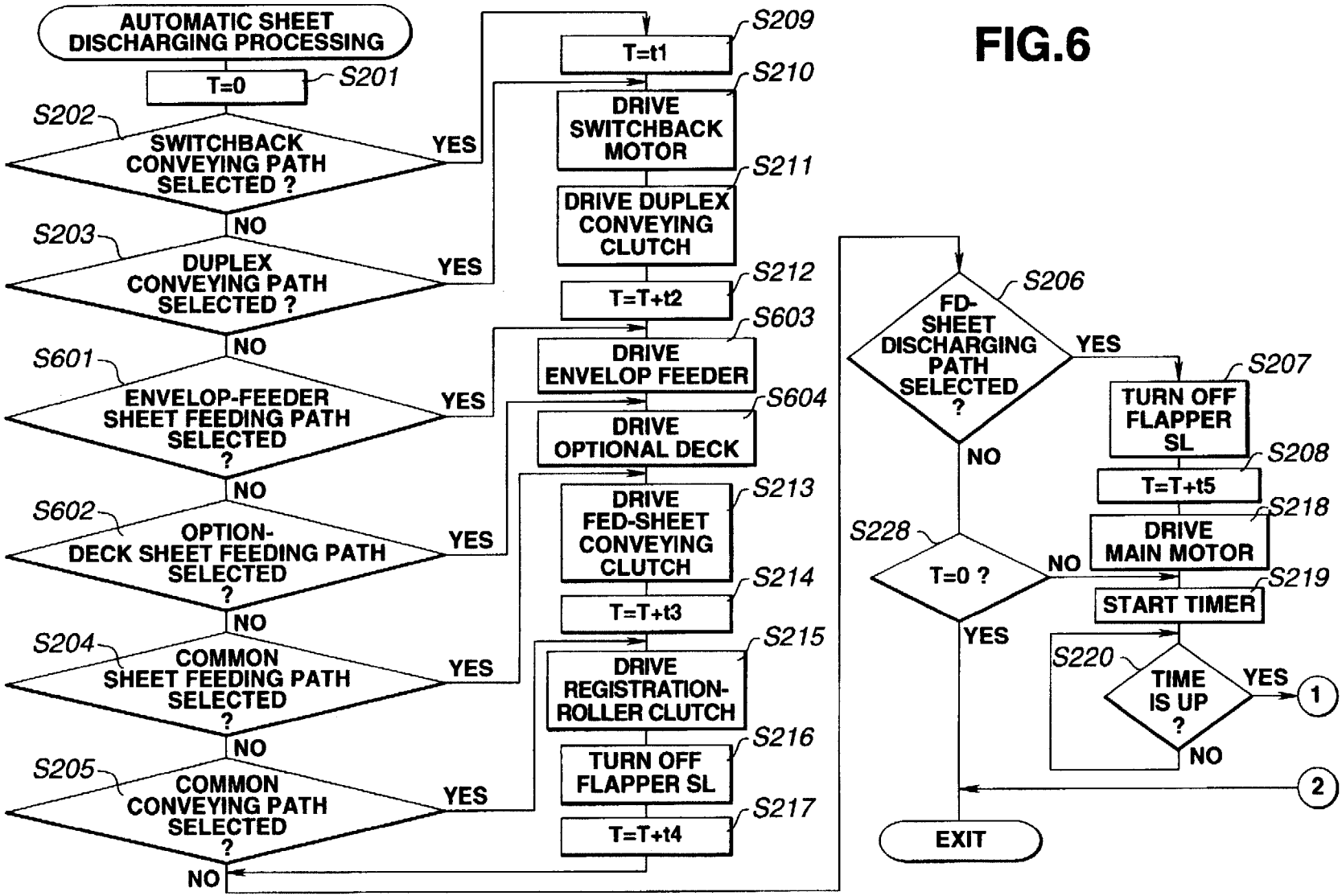
FIGS. 6 and 7 are flowcharts illustrating procedures of automatic sheet discharging processing in the second embodiment.
Figure 7:
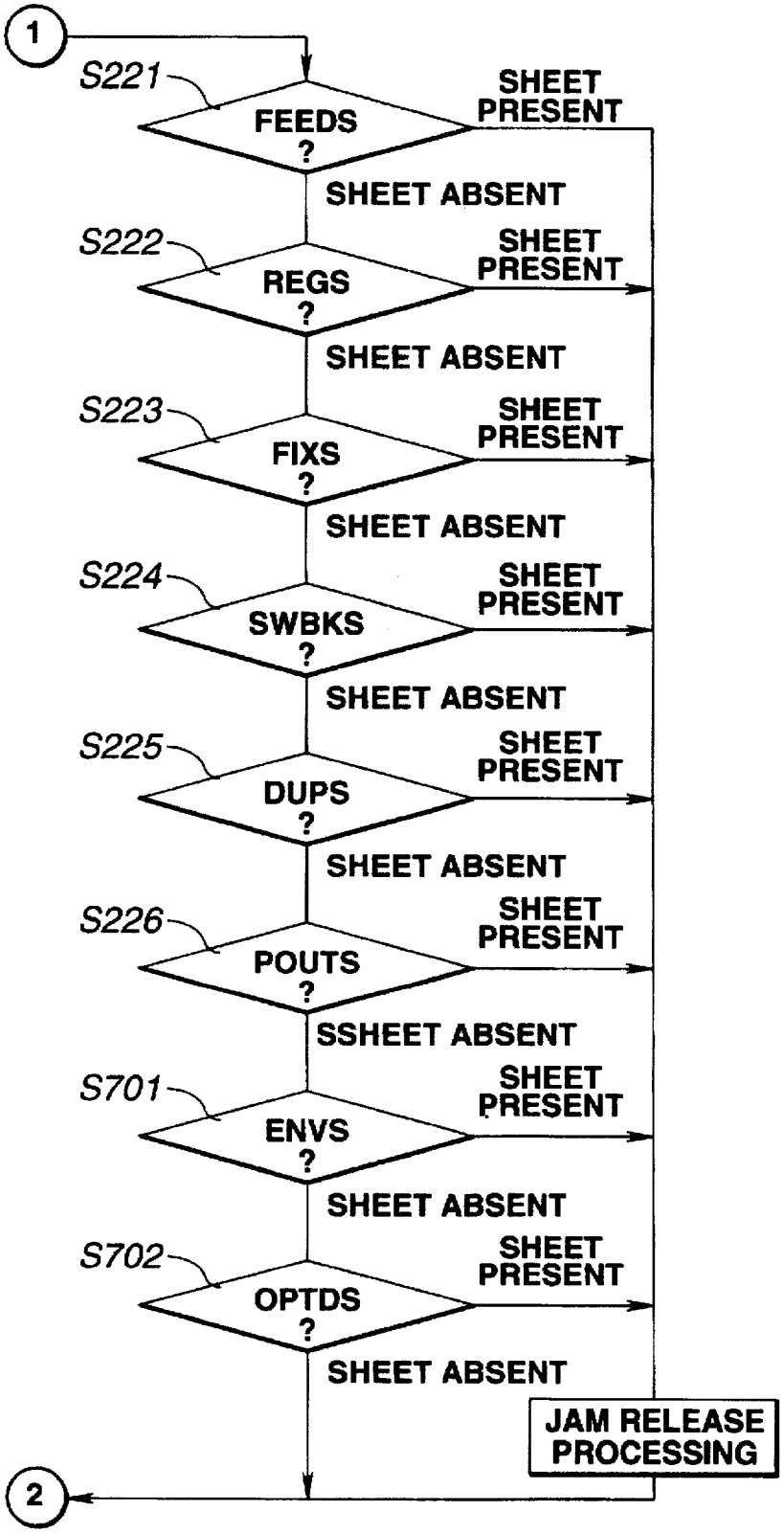

FIGS. 6 and 7 are flowcharts of the automatic sheet discharging processing in the second embodiment. Before the above-described processing of determining the selection of the common sheet feeding path in the first embodiment, it is determined in steps S601 and S602 if the envelope-feeder feeding path and the optional-deck sheet feeding path have been selected, respectively. If the results of the determination in steps S601 and S602 are affirmative, then, in steps S603 and S604, sheet feeding commands are transmitted to the envelope feeder 701 and the optional deck 704, respectively, through serial communication, to feed sheets. More specifically, in the envelope feeder 701, an envelope, serving as a sheet, is conveyed in the direction of an arrow H by the envelope feeding rollers 703. In the optional deck 704, a sheet is conveyed in the direction of an arrow J by the conveying rollers 706. Since the sheet-conveying time periods within the envelope feeder 701 and the optional deck 704 are short, these time periods are not added to the automatic sheet discharging time period T. When a sheet remains in each of a plurality of such fed-sheet conveying paths, by setting the maximum sheet discharging time period among discharging time periods necessary for the respective sheets as the automatic sheet discharging time period T, and by simultaneously starting the conveyance of the respective sheets, the plurality of remaining sheets can be discharged at a time. In steps S701 and S702 shown in FIG. 7, detection signals ENVS and OPTDS from the fed-envelope sensor 702 and the optional-deck sheet sensor 705 are read, respectively, to confirm the presence of respective sheets.

As described above, in the second embodiment, sheets in a plurality of conveying paths including a conveying path of an optional sheet feeding device can be discharged in a short time period by simultaneously conveying the sheets.

Third Embodiment

Figure 10:
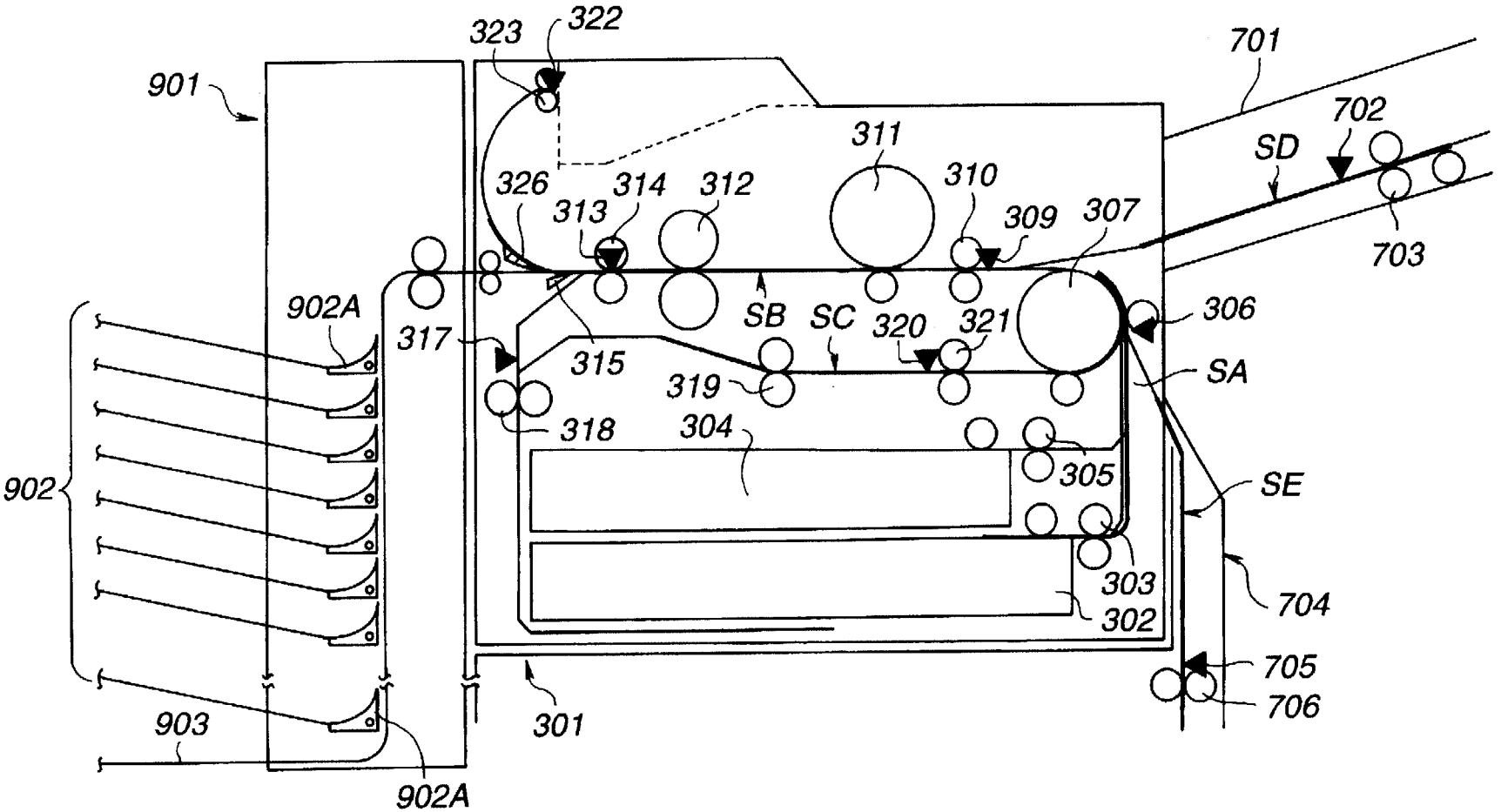
FIG. 10 is a schematic block diagram illustrating the configuration of the entirety of a recording apparatus according to the third embodiment.

FIG. 10 illustrates the configuration of a recording apparatus 301 according to a third embodiment of the present invention. The recording apparatus 301 of the third embodiment differs from the configuration of the second embodiment in that an optional output device (hereinafter termed an "optional sorter") 901 is connected. In FIG. 10, there are shown a plurality of sheet discharging bins 902. Sheets are allocated to the corresponding bins by controlling conveying-path switching flappers 902A present at the roots of the respective bins 902. Reference numeral 903 represents a stacker for discharging improper sheets. When any one of the conveying-path switching flappers 902A present at sides upstream of the stacker 903 does not operate, the corresponding sheet is discharged onto the stacker 903. The optional sorter 901 includes a control unit comprising a microprocessor (not shown), and exchanges information relating to instructions and states through serial communication with the CPU 401 of the recording apparatus 301.

Since processing of detecting sheets remaining in the apparatus is the same as the processing shown in FIG. 5 of the second embodiment, a further description thereof will be omitted.

Figure 9:
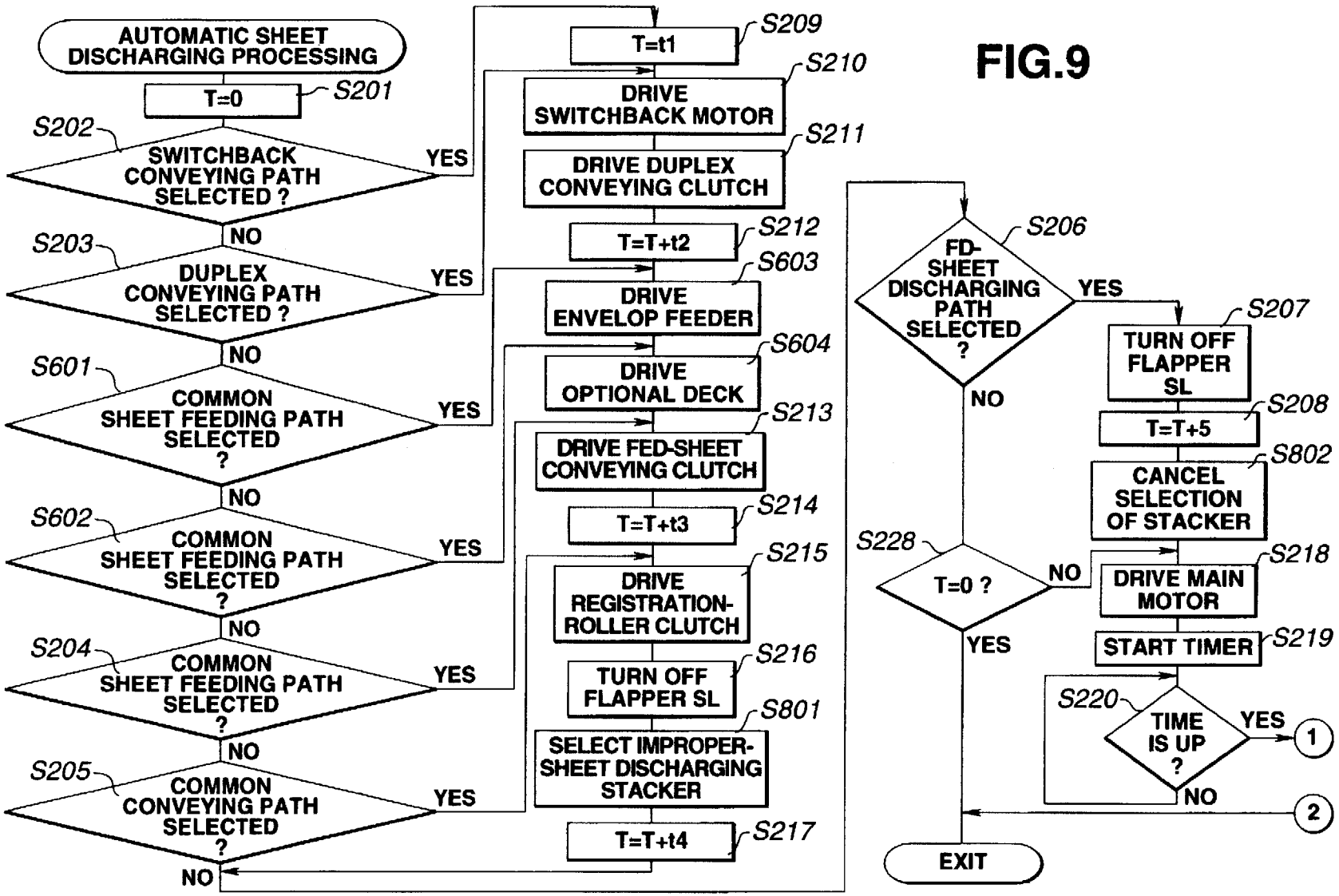
FIG. 9 is a flowchart illustrating procedures of automatic sheet discharging processing in a third embodiment of the present invention.

FIG. 9 is a flowchart of automatic sheet discharging processing in the third embodiment. The flowchart of FIG. 7 succeeds step S220 shown in FIG. 9. In step S216 in the second embodiment, a sheet is discharged onto the FU tray except when the sheet must be discharged onto the FD tray. In the third embodiment, however, since the optional sorter 901 is connected, in step S801 which follows step S216, the CPU 401 outputs an instruction to select the stacker 903 for discharging improper sheets to the optional sorter 901 through serial communication. Upon detection of a sheet at an entrance sensor (not shown), the optional sorter 901 which has received this instruction discharges the sheet onto the stacker 903 for discharging improper sheets. When it has been determined that the sheet is to be discharged onto the FD tray, then, in step S802, the instruction to select the stacker 903 for discharging improper sheets is cancelled.

Fourth Embodiment

Figure 11:
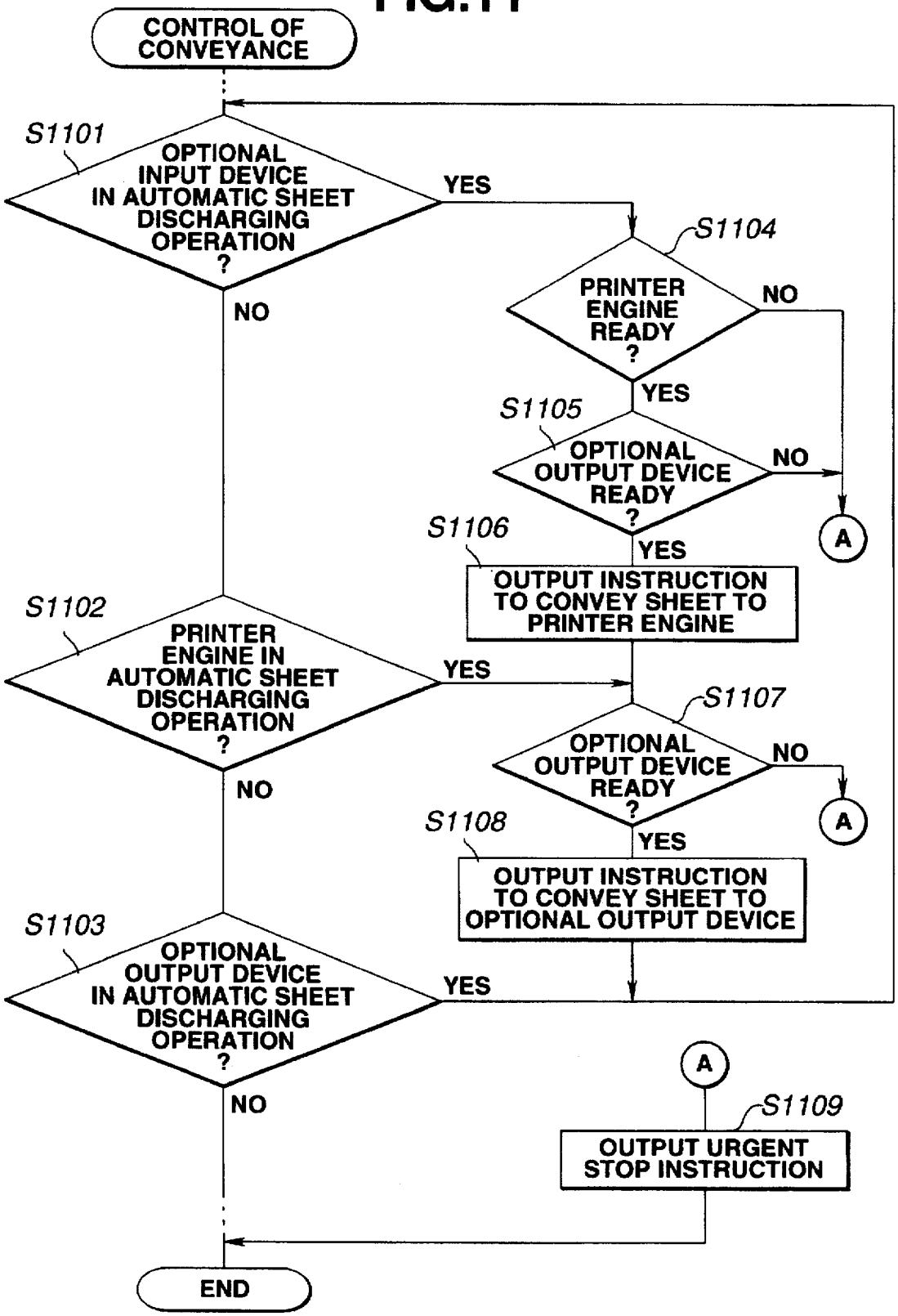
FIG. 11 is a flowchart illustrating the control of conveyance of a sheet in a fourth embodiment of the present invention.
Figure 12:
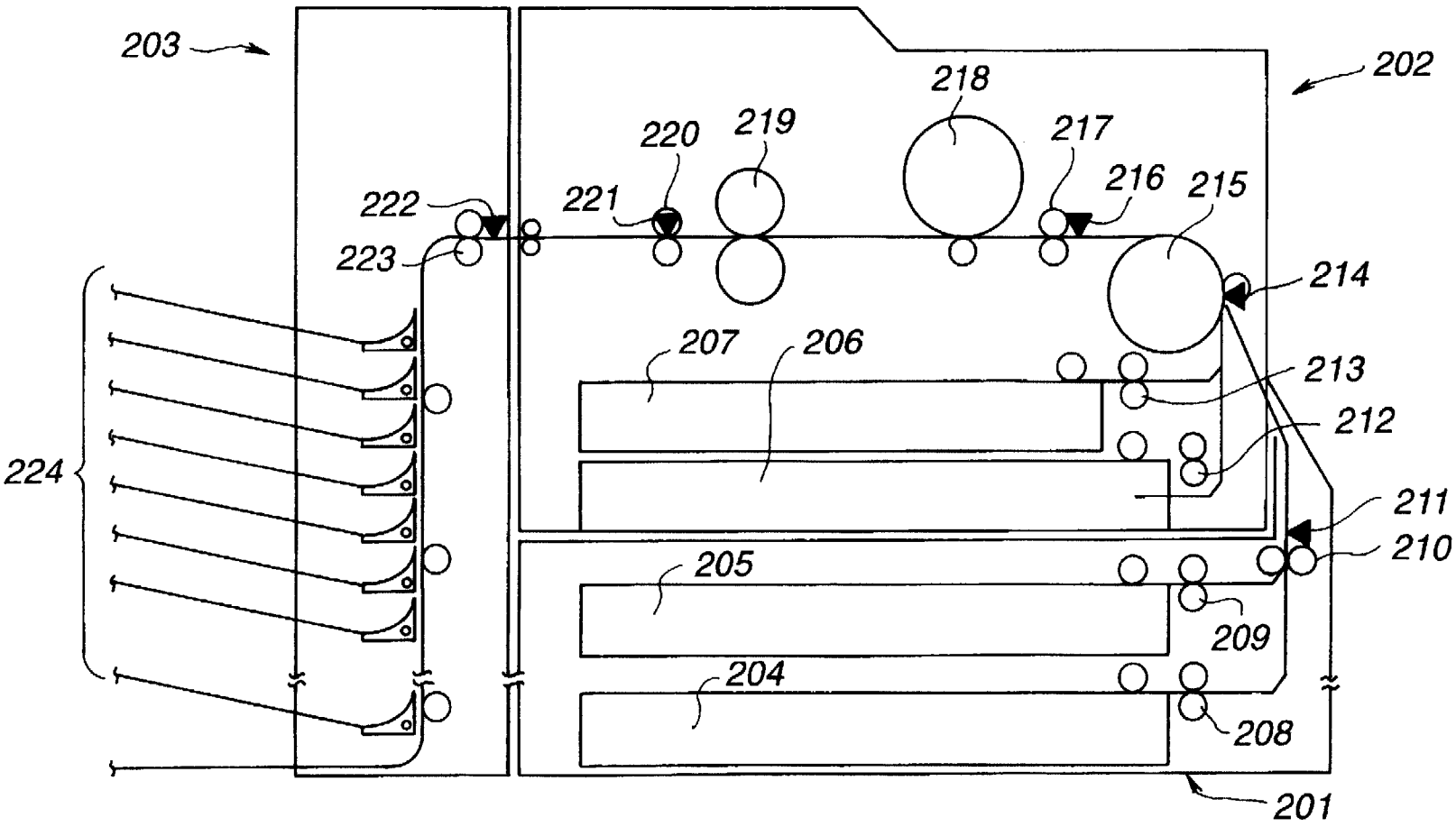
FIG. 12 is a schematic block diagram illustrating the configuration of the entirety of a recording apparatus according to the fourth embodiment.
Figure 13:
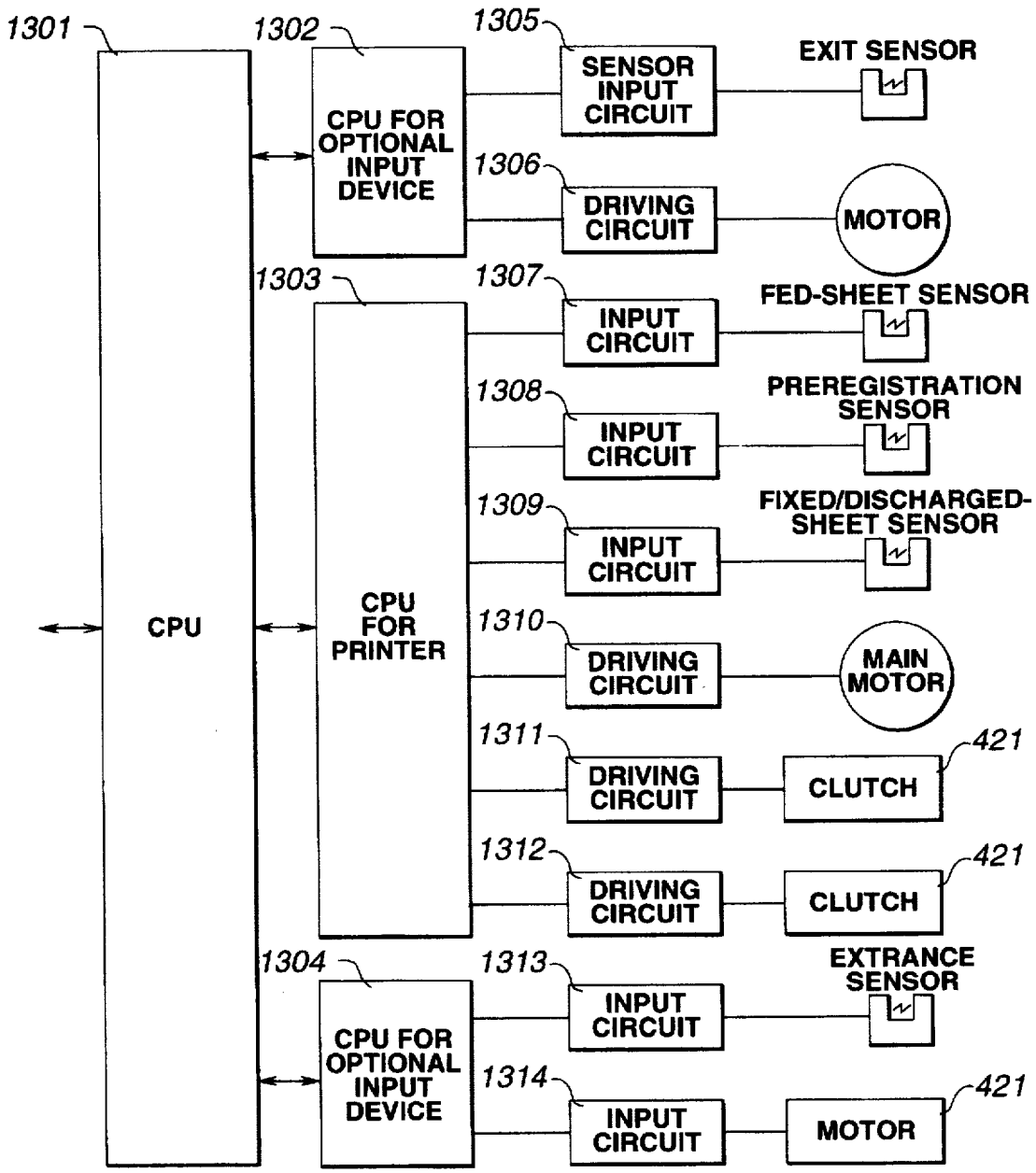
FIG. 13 is a block diagram illustrating the configuration of a control system in the recording apparatus shown in FIG. 12.

FIGS. 11 through 13 are diagrams illustrating a fourth embodiment of the present invention.

First, a description will be provided of the configuration of a recording apparatus according to the fourth embodiment with reference to FIG. 12. In FIG. 12, an optional input device 201 includes a lower deck 204 and an upper deck 205. Rollers 208 or 209 feed a sheet from the lower deck 204 or the upper deck 205, respectively. Conveying rollers 210 convey the sheet fed from the deck 204 or 205 into a printer 202. A sheet exit sensor 211 is disposed at a side downstream of the conveying rollers 210.

A lower deck 206 and an upper deck 207 are disposed within the printer 202, and include rollers 212 and 213 for feeding sheets, respectively. A fed-sheet sensor 214 provided within the printer 202 detects a sheet fed from the optional input device 201, and a sheet fed from the lower deck 206 or the upper deck 207 of the printer 202. A fed-sheet conveying roller 215 conveys the fed sheet until the sheet forms a predetermined loop at the position of registration rollers 217. A sheet sensor (hereinafter termed a "preregistration sensor") 216 is utilized for forming the loop of the sheet. The registration rollers 217 start to rotate immediately before an image is formed on the sheet by a photosensitive drum 218, and the sheet is discharged from the printer 202 via fixing rollers 219 and fixed-sheet discharging rollers 220. A sheet sensor 221 is disposed at the most downstream side of the sheet conveying path within the printer 202, and monitors the discharge of the sheet.

An optional output device 203 detects the sheet discharged from the printer 202 using an entrance sensor 222, receives the sheet using conveying rollers 223, and discharges the sheet onto the assigned one of sheet discharging bins 224.

FIG. 13 is a block diagram illustrating driving circuits for respective driving units and input circuits for the sensors of the sheet conveying mechanism shown in FIG. 12. In FIG. 13, reference numeral 1301 represents a microprocessor (hereinafter termed a "CPU") mounted in a video controller for controlling the printing system. The CPU 1301 processes image data and commands transmitted from the host device, and controls the respective units while performing serial communication with a microprocessor (hereinafter termed a "CPU") 1302 for controlling the optional input device 201, a microprocessor (hereinafter termed a "CPU") 1303 for controlling the printer engine, and a microprocessor (hereinafter termed a "CPU") 1304 for controlling the optional output device 203.

A sensor input circuit 1305 inputs a detection signal from the exit sensor 211 of the optional input device 201 to the CPU 1302. Reference numeral 1306 represents a driving circuit for a motor 1316 for rotating the conveying rollers 210 of the optional input device 201. The driving circuit 1306 is controlled by a driving signal output from the CPU 1302. The CPU 1302 feeds and conveys the sheet from the desired deck 204, 205, 206 or 207 in response to a sheet feeding command and a conveying command transmitted from the CPU 1301.

Reference numerals 1307, 1308 and 1309 represent input circuits for the fed-sheet sensor 214, the preregistration sensor 216 and the fixed/discharged-sheet sensor 221, respectively, disposed along the conveying path within the printer 202. Each of these input circuits inputs a detection signal from the corresponding sensor to the CPU 1303. Reference numeral 1310 represents a driving circuit for a main motor 1320 for driving all of the rollers and the photosensitive drum 218 within the printer 202. The driving circuit 1310 is controlled by a driving signal output from the CPU 1303. Reference numeral 1311 represents a driving circuit for a clutch 1321 for transmitting the revolution of the main motor 1320 to the fed-sheet conveying roller 215. The driving circuit 1311 is controlled by a driving signal output from the CPU 1303. Reference numeral 1312 represents a driving circuit for a clutch 1322 for transmitting the revolution of the main motor 1320 to the registration rollers 217. The driving circuit 1312 is controlled by a driving signal output fom the CPU 1303. The CPU 1303 conveys the sheet to the optional output device 203 in response to a conveying command transmitted from the CPU 1301.

A sensor input circuit 1313 inputs a detection signal from the entrance sensor 222 of the optional output device 203 to the CPU 1304. Reference numeral 1314 represents a driving circuit for a motor 1324 for rotating the conveying rollers 223 of the optional output device 203. The driving circuit 1314 is controlled by a driving signal output from the CPU 1304. The CPU 1304 conveys the sheet from the printer engine in response to a conveying command transmitted from the CPU 1301.

FIG. 11 is a flowchart illustrating the control of the CPU 1301 in the fourth embodiment. In the fourth embodiment, each of the optional input device 201, the printer 202 and the optional output device 203 performs an automatic sheet discharging operation based on the device's own determination. Upon completion of the initial setting of the system, the CPU 1301 obtains the status of each of the devices 201, 202 and 203 during warming-up of the device through serial communication.

First, in step S1101, it is determined if the optional device 201 is in an automatic sheet discharging operation. If the result of the determination in step S1101 is affirmative, then, in step S1104, it is determined if the printer engine present at the downstream side in the conveying direction of the optional input device 201 can convey the sheet. If the result of the determination in step S1104 is negative, then, in step S1109, an urgent stop instruction is output to all of the devices. If the result of the determination in step S1104 is affirmative, then, in step S1105, it is determined if the optional output device 203 can convey the sheet. If the result of the determination in step S1105 is negative, then, in step S1109, an urgent stop command is output to all the devices. If the result of the determination in step S1105 is affirmative, then, in step S1106, an instruction to convey the sheet is output to the printer engine. If the result of the determination in step S1101 is negative, the process proceeds to step S1102, where it is determined if the printer engine is performing an automatic sheet discharging operation. If the result of the determination in step S1102 is affirmative, the process proceeds to step S1107, where it is determined if the optional output device 203 is in a conveyable state. If the result of the determination in step S1107 is negative, the process proceeds to step S1109, where an urgent stop instruction is output to all of the devices. If the result of the determination in step S1107 is affirmative, the process proceeds to step S1108, where an instruction to convey the sheet is output to the optional output device 203. If the result of the determination in step S1102 is negative, the process proceeds to step S1103, where it is determined if the optional output device is performing an automatic sheet discharging operation. If the result of the determination in step S1103 is affirmative, or when another device is performing an automatic sheet discharging operation, the operations from step S1101 to step S1103 are repeated until the automatic sheet discharging operation is terminated.

Fifth Embodiment

FIG. 14 is a flowchart illustrating another example of the control of the CPU 1301 in the fourth embodiment as a fifth embodiment of the present invention.

In the fourth embodiment, each of the devices 201, 202 and 203 performs an automatic sheet discharging operation based on the device's own determination. In the fifth embodiment, however, each of the CPU's 1302, 1303 and 1304 of the respective devices outputs an automatic sheet discharging request status to the CPU 1301 through serial communication.

First, in a warming-up stage of each device as in the fourth embodiment, when it has been determined in step S1401 that a request for an automatic sheet discharging operation has been sent from the optional input device 201, the process proceeds to step S1404, where it is determined if the printer engine is in a conveyable state. If the result of the determination in step S1404 is negative, the process proceeds to step S1410, where it is determined if a status of incapability of conveyance has been input from the CPU 1302 for the printer engine. If the result of the determination in step S1410 is affirmative, the process proceeds to step S1413, where error processing is performed and the control is terminated. The status of incapability of conveyance is a status transmitted when a sheet jam or a problem occurs. The error processing in step S1413 is processing of notifying a display panel or the host computer that the sheet remains in the apparatus. If the result of the determination in step S1410 is negative, the process returns to step S1404, and it is awaited until the printer engine is in a conveyable state. When the printer engine has become in a conveyable state in step S1404, it is then determined in steps S1405 and S1411 if the optional output device 203 is in a conveyable state and if a status of incapability of conveyance of the optional output device 203 has been transmitted, respectively. If the result of the determination in step S1405 is affirmative, the process proceeds to step S1406, where an instruction to convey the sheet is output to the optional input device 201.

In step S1402, it is determined if a request for an automatic sheet discharging operation has been transmitted from the printer engine. If the result of the determination in step S1402 is affirmative, it is then determined in steps S1407 and S1412 if the optional output device 203 is in a conveyable state and if a status of incapability of conveyance has been transmitted, as in steps S1405 and S1411, respectively. If the result of the determination in step S1407 is affirmative, the process proceeds to step S1408, where an instruction to convey the sheet is output to the printer engine. In step S1403, it is determined if a request for an automatic sheet discharging operation has been transmitted from the optional output device 203. If the result of the determination in step S1403 is affirmative, the process proceeds to step S1409, where an instruction to convey the sheet is output to the optional output device 203.

In the fifth embodiment, an instruction to convey the sheet is output from the CPU 1301 after determining if the sheet can be conveyed in each device. Hence, synchronism between devices can be easily taken, and the problem which may occur in the fourth embodiment, i.e., the problem that an automatic sheet discharging operation must be given up because the timing of the start of an automatic sheet discharging operation in a certain device is too early, does not occur.

Sixth Embodiment

Figure 15:
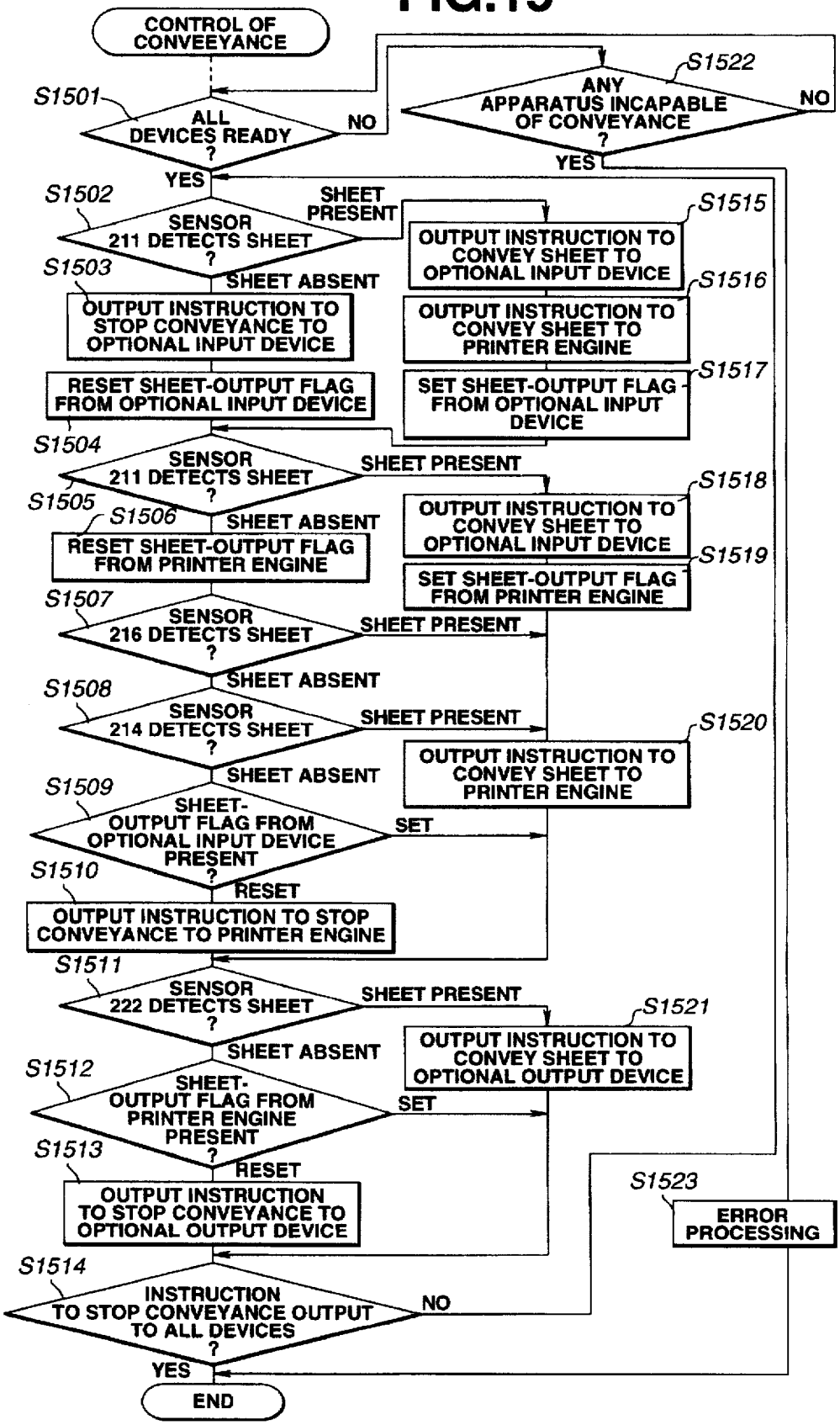
FIG. 15 is a flowchart illustrating the control of conveyance of a sheet in a sixth embodiment of the present invention.

FIG. 15 is a flowchart illustrating still another example of the control of the CPU 1301 in the fourth embodiment as a sixth embodiment of the present invention.

In the fifth embodiment, the CPU 1301 monitors the state of each device by receiving a status of a request of an automatic sheet discharging operation from the device, and outputs an instruction to convey the sheet. In the sixth embodiment, however, the CPU 1301 determines the necessity of an automatic sheet discharging operation using information from each sensor provided in the sheet coveying path, instead of using a status of a request of an automatic sheet discharging operation from each device.

First, in step S1501, it is determined if all devices under control are in a conveyable state. If the result of the determination in step S1501 is negative, the process proceeds to step S1522, where it is determined if an error status indicating incapability of conveyance has been transmitted. If the result of the determination in step S1522 is affirmative, the process proceeds to step S1523, where error processing is performed, and the control is terminated. The contents of the error processing are the same as in the fifth embodiment.

If the result of the determination in step S1501 is affirmative, the process proceeds to step S1502, where it is determined if the exit sensor 211 present in the sheet conveying path of the optional input device 501 detects a sheet. If the result of the determination in step S1502 indicates "the absence of a sheet", the process proceeds to step S1503, where an instruction to stop conveyance of a sheet is output to the optional input device 201. The process then proceeds to step S1504, where a flag announcing in advance sheet discharge from the optional input device 201 is reset. If the result of the determination in step S1502 indicates "the presence of a sheet", the process proceeds to step S1515, where an instruction to convey the sheet is output to the optional input device 201. The process then proceeds to step S1516, where an instruction to convey the sheet is output to the printer engine. The process then proceeds to step S1517, where a flag announcing in advance sheet discharge from the optional input device 201 is set. The process then proceeds to step S1505, where it is determined if the fixed/discharged-sheet sensor 221 present at the most downstream side in the sheet conveying path of the printer engine detects a sheet. If the result of the determination in step S1505 indicates "the absence of a sheet", the process proceeds to step S1506, where a flag annoucing in advance sheet discharge from the printer engine is reset. If the result of the determination in step S1505 indicates "the presence of a sheet", the process proceeds to step S1518, where an instruction to convey the sheet is output to the optional output device 203. The process then proceeds to step S1519, where a flag announcing in advance sheet discharge from the printer engine is set.

In steps S1507 and S1508, it is determined if the preregistration sensor 216 and the fed-sheet sensor 214 in the sheet conveying path within the printer engine detect sheets, respectively. If each of the results of the determination in steps S1507 and S1508 indicates the absence of a sheet, the process proceeds to step S1509, where it is determined if a flag announcing in advance sheet discharge from the optional input device 201 is present. If the result of the determination in step S1509 indicates "no flag", i.e., if a flag announcing in advance sheet discharge from the optional input device 201 is reset, the process proceeds to step S1510, where an instruction to stop conveyance of a sheet is output to the printer engine. If at least one the results of the determination in steps S1507 and S1508 indicates "the presence of a sheet", the process proceeds to step S1520, where an instruction to convey the sheet is output to the printer engine. In step S1511, it is determined if the entrance sensor 222 provided in the conveying path of the optional output device 203 detects a sheet. If the result of the determination in step S222 indicates "the absence of a sheet", the process proceeds to step S1512, where it is determined if a flag announcing in advance sheet discharge from the printer engine is present. If the result of the determination in step S1512 indicates "no flag", i.e., if a flag announcing in advance sheet discharge from the printer engine is reset, the process proceeds to step S1513, where an instruction to stop conveyance of the sheet is output to the optional output device 203. If the result of the determination in step S1511 indicates "the presence of a sheet", the process proceeds to step S1521, where an instruction to convey the sheet is output to the optional output device 203.

In step S1514, it is determined if an instruction to stop conveyance of the sheet has been output to all of the devices, i.e., whether or not it is unnecessary to perform an automatic sheet discharging operation, or if an automatic sheet discharging operation has been completed. If the result of the determination in step S1514 is affirmative, i.e., if an automatic sheet discharging operation is being performed, the processes from step S1802 to step S1813 are repeated.

As described above, in the sixth embodiment, the timing of sheet conveyance to each device can be changed based on information from the corresponding sensor in the sheet conveying path of the system. Hence, it is unnecessary to drive a motor for useless sheet conveyance.

Seventh Embodiment

Figure 16:
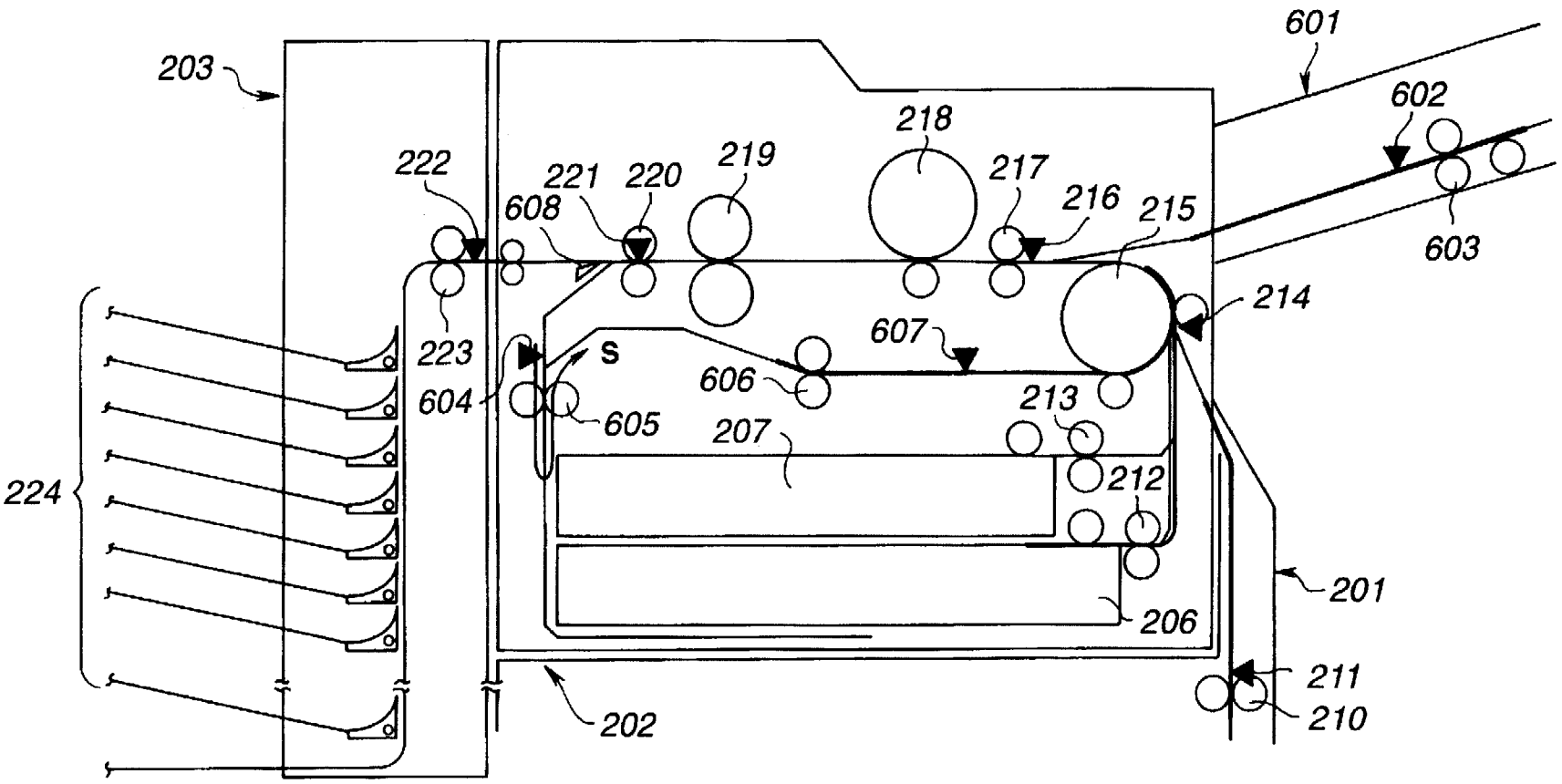
FIG. 16 is a schematic block diagram illustrating the configuration of the entirety of a recording apparatus according to a seventh embodiment of the present invention.

FIG. 16 is a diagram illustrating the configuration of a recording apparatus according to a seventh embodiment of the present invention. In the seventh embodiment, in addition to the configuration shown in FIG. 12 of the fourth embodiment, a feeder dedicated for envelopes (hereinafter termed an "envelope feeder") 601, and a duplex conveying mechanism for duplex printing are included within the main body 202 of the recording apparatus.

The envelope feeder 601 feeds an envelope into the main body 202 of the recording apparatus using envelope feeding rollers 603. A sheet sensor 602 is provided along the sheet feeding path.

The duplex conveying mechanism comprises a duplex flapper 608, a switchback sensor 604, switchback rollers 605, duplex conveying rollers 606, and a duplex sensor 607. When performing duplex printing, a sheet is fed into the duplex conveying mechanism by operating the duplex flapper 608. As indicated by an arrow S in FIG. 16, the sheet is subjected to switchback by the switchback rollers 605 after passing through the switchback sensor 604, then passes through the duplex conveying rollers 606 and the duplex sensor 607, and is refed by a fed-sheet conveying roller 215.

FIG. 7 is a block diagram of a control system of the recording apparatus of the seventh embodiment. In the seventh embodiment, a microprocessor (hereinafter termed a "CPU") 1701 for controlling the envelope feeder 601, and a microprocessor (hereinafter termed a "CPU") 1702 for controlling the duplex conveying mechanism are added to the configuration of the fourth embodiment shown in FIG. 13. The CPU 1301 processes image data and commands transmitted from the host computer, and controls the respective units while performing serial communication with the CPU 1302 for controlling the optional input device 201, the CPU 1303 for controlling the printer engine, the CPU 1304 for controlling the optional output device 203, and the CPU 1701 for controlling the envelope feeder 601. The CPU 1303 for controlling the printer engine controls duplex conveyance while performing serial communication with the CPU 1702 for controlling the duplex conveying mechanism.

Since processing of detecting a sheet remaining in the apparatus in the seventh embodiment is the same as the processing shown in FIG. 5 of the second embodiment, a further description thereof will be omitted.

Figure 18:
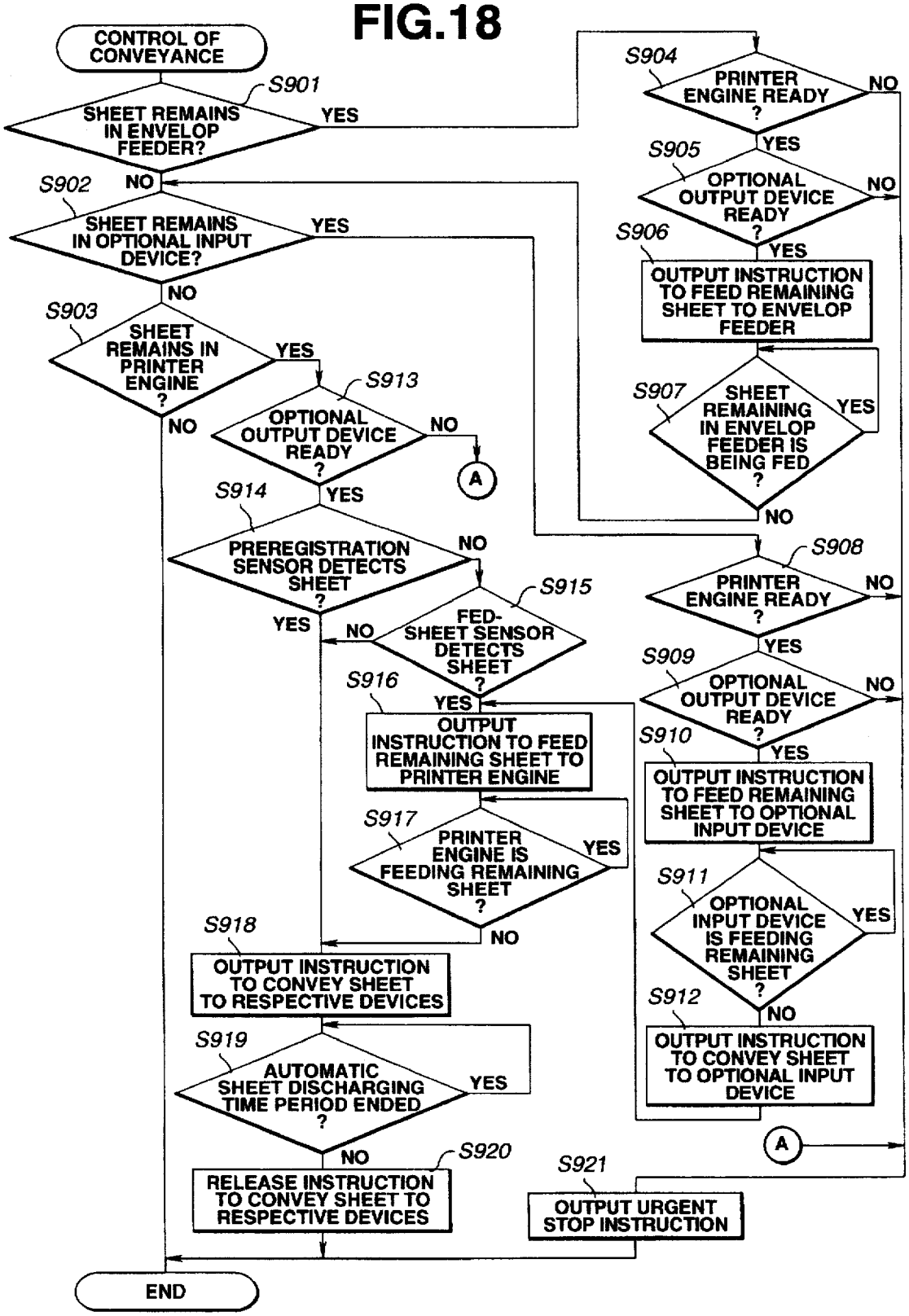
FIG. 18 is a flowchart illustrating the control of conveyance of a sheet in the recording apparatus shown in FIG. 16.

FIG. 18 is a flowchart of automatic sheet discharging processing when a sheet remaining in the apparatus has been detected by the processing of detecting a sheet remaining in the apparatus. After performing initial setting of the system, the CPU 1301 obtains information relating to a sheet remaining in the apparatus, i.e., detection information from each sensor according to the processing of detecting a sheet remaining in the apparatus, and peforms the control of an automatic sheet discharging operation shown in FIG. 18 based on this information.

First, in step S901, it is determined if a sheet remains in the envelope feeder 601. If the result of the determination is affirmative, the process proceeds to step S904, where it is determined if the printer engine present at the downstream side in the conveying direction of the envelope feeder 601 can convey the sheet. If the result of the determination in step S904 is negative, the process proceeds to step S921, where an urgent stop instruction is output to all of the devices. If the result of the determination in step S904 is affirmative, the process proceeds to step S905, where it is determined if the optional output device 203 can convey the sheet. If the result of the determination in step S905 is affirmative, the process proceeds to step S906, where an instruction to feed the remaining sheet is output to the envelope feeder 601. Upon reception of the instruction to feed the remaining sheet, the envelope feeder 601 operates the driving units for a time period for conveying the sheet from the fed-envelope sensor 602 to the registration rollers 217 (an operation of feeding the remaining sheet), and then stops. Thus, the sheet remaining in the envelope feeder 601 is conveyed to the registration rollers 217. Then, in step S907, it is determined if the sheet remaining in the envelope feeder 601 is being fed. If the result of the determination in step S907 is negative, i.e., when the operation of feeding the remaining sheet has been terminated, the process proceeds to step S902.

In step S902, it is determined if a sheet remains in the optional input device 201. If the result of the determination in step S902 is affirmative, the process proceeds to step S908, where it is determined if the printer engine present at the downstream side in the conveying direction of the optional input device 201 can convey the sheet. If the result of the determination in step S908 is negative, the process proceeds to step S921, where an urgent stop instruction is output to all of the devices. If the result of the determination in step S908 is affirmative, the process proceeds to step S909, where it is determined if the optional output device 203 can convey the sheet. If the result of the determination in step S909 is negative, the process proceeds to step S921, where an urgent stop instruction is output to all of the devices. If the result of the determination in step S909 is affirmative, the process proceeds to step S910, where an instruction to feed the remaining sheet is output to the optional input device 201. Upon reception of the instruction to feed the remaining sheet, the optional input device 201 operates the driving units for a time period for conveying the sheet from the exit sensor 211 to the fed-sheet conveying roller 215 of the optional input device 201 (an operation of feeding the remaining sheet), and then stops. Thus, the sheet remaining in the optional input device 201 is conveyed to the fed-sheet conveying roller 215. In step S911, it is awaited until the operation of feeding the remaining sheet of the optional input device 201 is completed. Upon completion of the operation of feeding the remaining sheet, the process proceeds to step S912. In step S912, an instruction to convey the sheet is output to the optional input device 201, and the process then proceeds to the control of feeding the sheet remaining in the printer engine after step S916.

If the result of the determination in step S902 is negative, the process proceeds to step S903, where it is determined if a sheet remains in the printer engine. If the result of the determination in step S903 is affirmative, the process proceeds to step S913, where it is determined if the optional output device 203 can convey the sheet. If the result of the determination in step S913 is negative, the process proceeds to step S921, where an urgent stop instruction is output to all of the devices.

If the result of the determination in step S913 is affirmative, the process proceeds to step S914, where it is determined if the preregistration sensor 216 has detected a sheet when the above-described processing of detecting the sheet remaining in the apparatus has been performed. If the result of the determination in step S914 is affirmative, the process proceeds to step S918, where an instruction to convey the sheet is output to the respective devices (the optional input device 201, the printer 202, the optional output device 203 and the envelope feeder 601) constituting the system. If the result of the determination in step S914 is negative, the process proceeds to step S915, where it is determined if the fed-sheet sensor 214 has detected a sheet when the above-described processing of detecting the sheet remaining in the apparatus has been performed. If the result of the determination in step S915 is negative, the process proceeds to step S918, where an instruction to convey the sheet is output to all of the devices constituting the apparatus. If the result of the determination in step S915 is affirmative, the process proceeds to step S916, where an instruction to feed the remaining sheet is output to the printer engine. Upon reception of the instruction to feed the remaining sheet, the printer engine operates the driving units for a time period for conveying the sheet from the fed-sheet sensor 214 to the registration rollers 217 (an operation of feeding the remaining sheet), and then stops. Thus, the sheet detected by the fed-sheet sensor 214 is conveyed to the registration rollers 217. Then, in step S917, the completion of the operation of feeding the sheet remaining in the printer engine is awaited. Upon the completion of the operation of feeding the remaining sheet, the process proceeds to step S918. In step S918, an instruction to convey the sheets is output to all of the devices constituting the system. In step S919, it is determined if a predetermined automatic sheet discharging time period has ended. If the result of the determination in step S919 is affirmative, the process proceeds to step S920, where the instruction to convey the sheets is released for the respective devices, and the process is terminated.

By performing the above-described control, it is possible to hold sheets remaining in the sheet feeding units of the respective devices before the registration rollers 215, and to discharge the sheets at a time.

The above-described configurations can also be applied to a copier or a facsimile apparatus.

The individual components shown in outline or designated by blocks in the drawings are all well known in the image forming apparatus arts and their specific construction and operation are not critical to the operation or the best mode for carrying out the invention.

While the present invention has been described with respect to what are presently considered to be the preferred embodiments, it is to be understood that the invention is not limited to the disclosed embodiments. To the contrary, the present invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. An image forming apparatus comprising:

image forming means for forming an image on a sheet;

first conveying means for conveying a sheet along a first conveying path toward said image forming means;

second conveying means for conveying a sheet along a second conveying path toward said image forming means;

first detection means for detecting a sheet remaining in the first conveying path;

second detection means for detecting a sheet remaining in the second conveying path; and control means for discharging the sheets in the first and second conveying paths from said image forming apparatus by simultaneously driving said first and second conveying means whether or not the sheets in the first and second conveying paths are conveyed superposed in said image forming means, in accordance with the detection of the remaining sheets by said first and second detection means, before said image forming means starts image formation.

2. An image forming apparatus according to claim 1, wherein said first conveying means conveys a sheet passing through said image forming means again to said image forming means.

3. An image forming apparatus according to claim 1, wherein said second conveying means conveys a sheet from a sheet accommodating unit.

4. An image forming apparatus according to claim 1, wherein said control means discharges the remaining sheets when electric power is supplied to said image forming apparatus.

5. An image forming apparatus according to claim 1, wherein said control means discharges the remaining sheets after jam release processing in said image forming apparatus by an operator.

6. An image forming apparatus according to claim 1, wherein said control means prevents discharge of the remaining sheets when said first and second detection means do not detect remaining sheets.

7. An image forming apparatus comprising:

image forming means for forming an image on a sheet;

first conveying means for conveying a sheet along a first conveying path toward said image forming means;

second conveying means for conveying a sheet along a second conveying path toward said image forming means; and control means for discharging the sheets remaining in the first and second conveying paths from said image forming apparatus by simultaneously driving said first and second conveying means whether or not the sheets remaining in the first and second conveying paths are conveyed superposed in said image forming means, before said image forming means starts image formation.

* * * * *

UNITED STATES PATENT AND TRADEMARK OFFICE

CERTIFICATE OF CORRECTION

PATENT NO. : 5,713,060

DATED : January 27, 1998

INVENTOR(S) : KAoru SATO, et al.

It is certified that error appears in the above-indentified patent and that said Letters Patent is hereby corrected as shown below:

Title Page, [75] Inventors, delete "Numazi" and insert therefor --Numazu--.

Figure 5, S111, delete "SWTCHBACK" and insert therefor --SWITCHBACK--.

Figure 6, S601 and S603, delete "ENVELOP", both occurrences and insert therefor --ENVELOPE--.

Figure 7, below S226, delete "SSHEET" and insert therefor --SHEET--.

Figure 9, S603, delete "ENVELOP" and insert therefor --ENVELOPE--.

Figure 15, top left entry, delete "CONVEEYANCE" and insert therefor --CONVEYANCE--.

Figure 17:
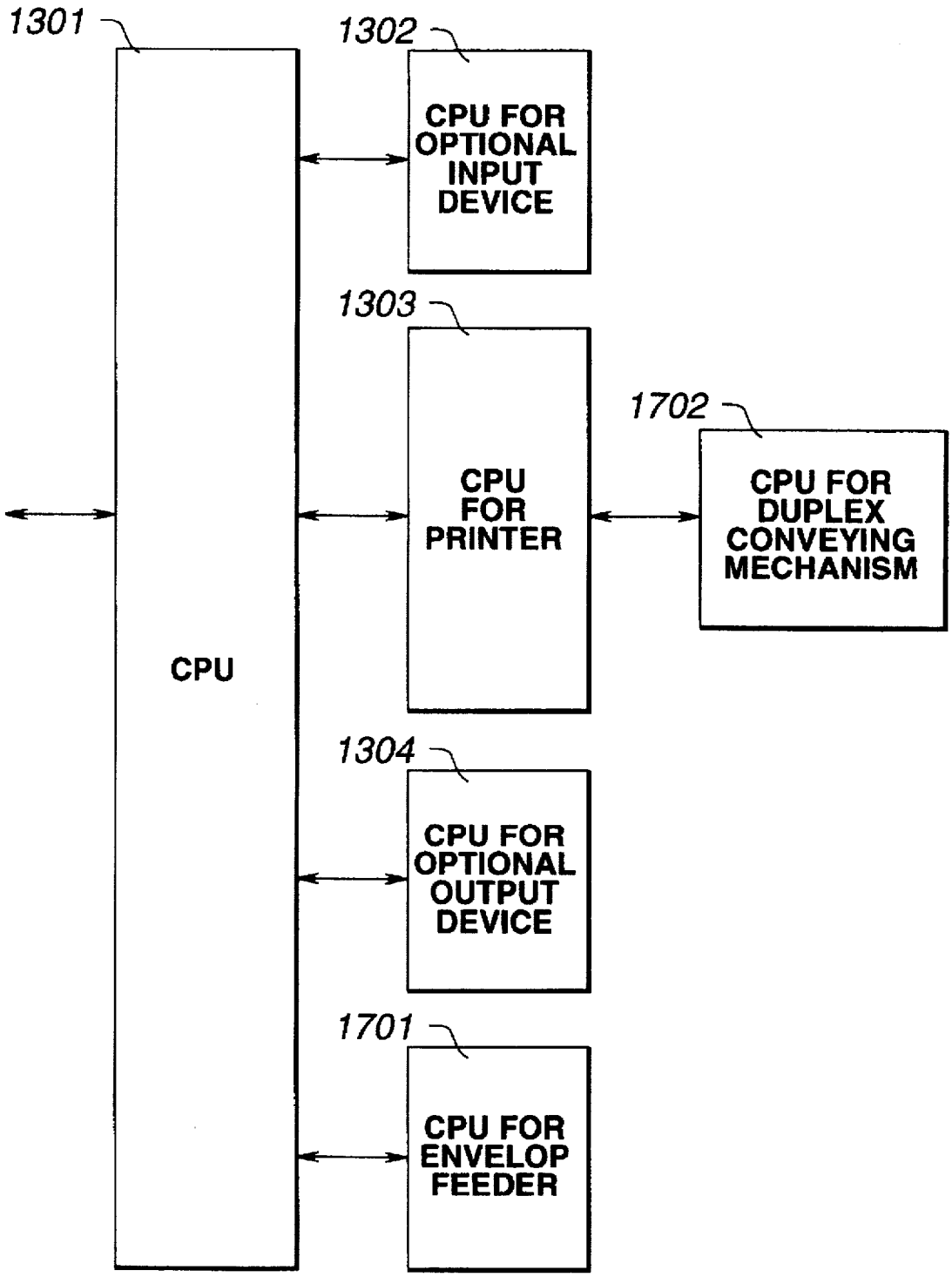
FIG. 17 is a block diagram illustrating the configuration of a control system in the recording apparatus shown in FIG. 16.

Figure 17, 1701, delete "ENVELOP" and insert therefor --ENVELOPE--.

Figure 18, S901, S906 and S907, delete "ENVELOP", each occurrence, and insert therefor --ENVELOPE--.

Column 1, lines 11 and 12, delete "because of" and insert therefor --for--.

Column 3, lines 44, 46 and 61, delete "418", each occurrence, and insert therefor --416--.

Column 4, lines 40 and 41, delete "308", both occurrences, and insert therefor --306--.

UNITED STATES PATENT AND TRADEMARK OFFICE

CERTIFICATE OF CORRECTION

PATENT NO. : 5,713,060

DATED : January 27, 1998

INVENTOR(S) : KAoru SATO, et al.

It is certified that error appears in the above-indentified patent and that said Letters Patent is hereby corrected as shown below:

Column 5, lines 43 and 52, delete "308", both occurrences, and insert therefor --306--.

Column 9, line 62, delete "fom" and insert therefor --from--.

Column 12, line 9, delete "501" and insert therefor --201--;
Line 30, delete "annoucing" and insert therefor --announcing--.

Signed and Sealed this

Seventh Day of July, 1998

Bruce Lehman

*Attest:*

BRUCE LEHMAN

*Attesting Officer*

*Commissioner of Patents and Trademarks*